US008358954B2

(12) United States Patent
Tanaka

(10) Patent No.: US 8,358,954 B2
(45) Date of Patent: Jan. 22, 2013

(54) IMAGE FORMING APPARATUS WITH OPENABLE AND MOVABLE MEMBERS

(75) Inventor: Noriaki Tanaka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 477 days.

(21) Appl. No.: 12/604,464

(22) Filed: Oct. 23, 2009

(65) Prior Publication Data

US 2010/0104326 A1 Apr. 29, 2010

(30) Foreign Application Priority Data

Oct. 24, 2008 (JP) ..... 2008-274278

(51) Int. Cl.
*G03G 21/16* (2006.01)
*G03G 21/18* (2006.01)

(52) U.S. Cl. ..... 399/111; 399/112

(58) Field of Classification Search ..... 399/111, 399/112, 119, 223, 298, 299, 302
See application file for complete search history.

(56) References Cited

U.S. PATENT DOCUMENTS 7,509,071 B2 * 3/2009 Yoshimura et al. ..... 399/111
7,715,752 B2 * 5/2010 Sakurai et al. ..... 399/110
7,761,024 B2 * 7/2010 Imaizumi et al. ..... 399/90
7,773,905 B2 * 8/2010 Kuruma ..... 399/90
2007/0071494 A1 3/2007 Igarashi et al.

FOREIGN PATENT DOCUMENTS

JP 2005157112 A * 6/2005
JP 2007316367 A * 12/2007
JP 2008310292 A * 12/2008

* cited by examiner

*Primary Examiner* — Robert Beatty
(74) *Attorney, Agent, or Firm* — Fitzpatrick, Cella, Harper & Scinto

(57) ABSTRACT

An image forming apparatus includes a cartridge including at least one of an image bearing member and a developing device; a main assembly including an opening; an openable member movable between a closed position in which the opening is covered and an open position in which the opening is exposed; and a movable member for supporting the cartridge. The movable member is movable between an inside position in which the cartridge is located inside the main assembly and a pulled out position in which the movable member is outwardly pulled out from the main assembly. The openable member is prevented, from moving from the open position to the closed position, in a state in which the movable member is located outside the open position but is movable from the open position to the closed position in a state in which the movable member is located at the open position.

7 Claims, 16 Drawing Sheets

(a) DOOR 31:CLOSE (b) DOOR 31:OPEN

IMAGE FORMING APPARATUS WITH OPENABLE AND MOVABLE MEMBERS

FIELD OF THE INVENTION AND RELATED ART

The present invention relates to an image forming apparatus, to which a cartridge is detachably mountable, for forming an image on a recording material (medium).

The image forming apparatus includes, e.g., those of an electrophotographic type, an electrostatic recording type, a magnetic recording type, and the like, such as a copying machine, a printer (a laser beam printer, an LED printer, or the like), a facsimile machine, a word processor, and the like.

The cartridge includes at least one of an image bearing member on which a latent image is to be formed and a developing means for developing the latent image formed on the image bearing member with a developer and is detachably mountable to an apparatus main assembly. The apparatus main assembly is a portion of the image forming apparatus except the cartridge and a movable member for moving the cartridge. The cartridge is mountable to and demountable from the apparatus main assembly by a user himself (herself). For that reason, maintenance of the apparatus main assembly can be easily performed.

The image bearing member is a member on which the latent image (such as an electrostatic latent image, a potential latent image, a resistance latent image, or a magnetic latent image) to be developed with the developer is formed. Examples of the image bearing member may include an electrophotographic photosensitive member (photoconductor) in an electrophotographic process, an electrostatic recording dielectric member in an electrostatic recording process, and a magnetic recording magnetic member in a magnetic recording process.

As a cartridge exchanging method with respect to the apparatus main assembly of the image forming apparatus, as described in U.S. Patent Application Publication No. 2007/0071494, there has been known a constitution in which a plurality of cartridges is accommodated in a pull-out tray and the cartridges are exchanged in a state in which the pull-out tray is pulled out forward.

In the case of such an image forming apparatus, a cartridge exchanging operation is performed by opening a door, pulling out the pull-out tray after releasing lock of the pull-out tray, and then exchanging the cartridge.

However, when the user pulls out the pull-out tray, the pull-out tray cannot be pulled out to fail the exchange of the cartridge in the case where the user does not know the presence of a locking mechanism or a lock-releasing method.

SUMMARY OF THE INVENTION

A principal object of the present invention is provide an image forming apparatus which has further improved in operativity so that a user can easily exchange a desired cartridge.

According to an aspect of the present invention, there is provided an image forming apparatus for forming an image on a recording material, comprising:

a cartridge including at least one of an image bearing member on which a latent image is to be formed and developing means for developing with a developer the latent image formed on the image bearing member;

a main assembly including an opening;

an openable member movable between a closed position in which the opening is covered and an open position in which the opening is exposed; and a movable member for supporting the cartridge, the movable member being movable between an inside position in which the cartridge is located inside the main assembly and a pulled-out position in which the movable member having passed through the opening is outwardly pulled-out from the main assembly and the cartridge is mountable to and demountable from the movable member outside the main assembly;

wherein the movable member is moved in a direction from the inside position toward the pulled-out position by movement of the openable member from the closed position to the open position, so that the movable member is located at an exposed position in which a part of the movable member having passed through the opening is exposed outside the main assembly, and wherein the openable member prevented, from moving from the open position to the closed position, in which the movable member is located outside the exposed position but is movable from the open position to the closed position in a state in which the movable member is located at the exposed position.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

[Embodiment 1]

(General Structure of Image Forming Apparatus)

Figure 1:
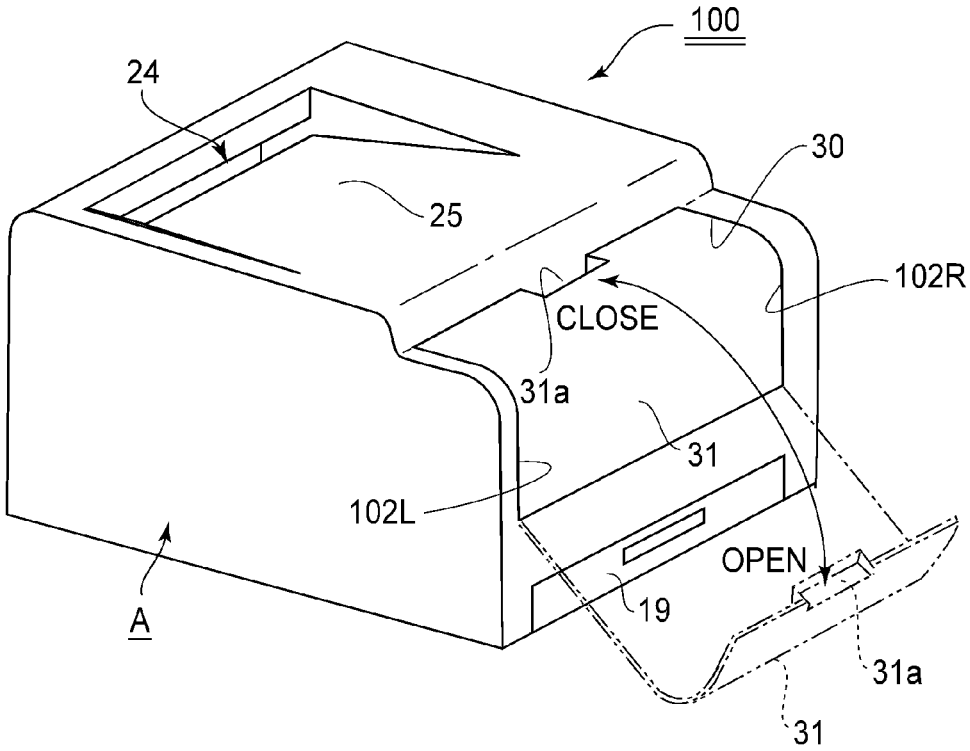
FIG. 1 is a perspective view of an outer appearance of an image forming apparatus in Embodiment 1.

FIG. 1A is a perspective view of an outer appearance of a color electrophotographic image forming apparatus 100 in this embodiment, and FIG. 1B is a longitudinal left side sectional view of the image forming apparatus 100. The image forming apparatus 100 is a four color-based full-color electrophotographic laser printer using an electrophotographic process. That is, the image forming apparatus 100 (printer) forms an image on a recording material (a sheet, an OHP sheet, a label, etc.) on the basis of an electrical image signal input from an external host device (not shown) such as a personal computer, an image reader, or a remote facsimile machine.

In the following description, a front side (front surface side) of the image forming apparatus 100 means the side on which a door 31 as an openable member with respect to an opening 30 of an apparatus main assembly A is provided. A rear side of the image forming apparatus 100 is the side opposite to the front side. A front-rear direction includes a frontward direction toward front as seen from the rear side of the apparatus main assembly A and a rearward direction opposite to the frontward direction. The left and right sides means the left and right sides as seen from the front side of the apparatus main assembly A. A left-right direction includes a leftward direction toward left as seen from the front side and a rightward direction opposite to the leftward direction.

In an apparatus main assembly 100A of the image forming apparatus 100, four (first to fourth) process cartridges PY, PM, PC and PK are horizontally arranged side by side in this order in terms of the rear-to-front direction (inline or tandem arrangement). The four process cartridges have the same constitution except that colors of developers (toners) accommodated therein are different from each other. Each cartridge in this embodiment includes an electrophotographic photosensitive drum 1 as an image bearing member on which a latent image is to be formed, and further includes a charging means 2, developing means 3, and a cleaning means 4 which are used as image forming process means acting on the drum 1. Further, each cartridge is prepared by integrally mounting the above-described drum 1, the charging means 2, the developing means 3, and the cleaning means 4 in a cartridge frame 5. The charging means 2 in this embodiment is a charging roller. The developing means 3 includes a developing roller 3*a* and a developer container 3*b* in which the developer (toner) is accommodated. The cleaning means 4 is of a blade type.

The container 3*b* of the first cartridge PY stores yellow (Y) toner. On the surface of the drum 1, a developer image of yellow (Y) is formed. The developing device 3 of the second cartridge PM stores magenta (M) toner. On the surface of the drum 1, a developer image of magenta (M) is formed. The developing device 3 of the third cartridge PC stores cyan (C) toner. On the surface of the drum 1, a developer image of cyan (C) is formed. The developing device 3 of the fourth cartridge PK stores black (K) toner. On the surface of the drum 1, a developer image of black (K) is formed.

Above the first to fourth cartridges PY, PM, PC, and PK, a laser scanner unit 11 is disposed. This scanner unit 11 outputs laser light L modulated correspondingly to image (picture) information for each color input from the external host device. The output laser light L enters each cartridge through an exposure window 6 provided at an upper surface of the cartridge frame 5. Thus, laser scanning exposure is performed on the surface of the drum 1.

An intermediary transfer belt unit 12 is disposed below the cartridges PY, PM, PC, and PK. The belt unit 12 includes an endless belt 13 having flexibility, a driving roller 14, a turn roller 15, and a tension roller 16 around which the belt 13 is stretched and circulatively moved. The driving roller 14 and tension roller 16 are disposed on the rear side of the apparatus main assembly A. The turn roller 15 is disposed on the front side of the apparatus main assembly A. A lower surface of the drum 1 of each cartridge contacts an upper surface of an upper belt portion of the belt 13. Inside the belt 13, four primary transfer rollers 17 are disposed. Each primary transfer roller 17 is disposed opposite to the drum 1 of the corresponding cartridge through the upper belt portion of the belt 13. A secondary transfer roller 2 contacts the belt 13 and opposes the driving roller 14 through the belt 13.

Below the belt unit 12, a (sheet) feeding unit 18 is disposed, which includes a (sheet) feeding tray 19, a (sheet) feeding roller 20, and a separation pad 21, and the like. The tray 20 is detachably mountable in the apparatus main assembly A from the front side of the apparatus main assembly A (front loading).

At an upper portion on the rear side of the apparatus main assembly A, a fixing device 23 and a (sheet) discharging roller pair 24 are disposed. Further, at an upper surface of the apparatus main assembly A, a (sheet) discharging tray 25 is provided. The fixing device 23 includes a fixation film assembly 23*a* and a pressing roller 23*b*. The discharging roller pair 24 includes rollers 24*a* and 24*b*.

Each cartridge P placed in a state in which it is set at a set position in the apparatus main assembly A is urged by an urging member (not shown) to be held in a state in which each cartridge is fixed to a predetermined positioning portion. To a drive input portion (not shown) of each cartridge, a driving output portion (not shown) of the apparatus main assembly A is connected. Further, to an electrical contact (not shown) of each cartridge, an electric energy supplying system (not shown) of the apparatus main assembly A is electrically connected.

An operation for forming a full-color image is as follows. The drum 1 of each of the first to fourth cartridges PY, PM, PC and PK is rotationally driven at a predetermined control speed in the counterclockwise direction indicated by the arrow. Further, the belt 13 is rotationally driven in the clockwise direction indicated by an arrow (the (normal) rotational direction of the drum 1) at a speed which corresponds to the speed of the drum 1. The scanner unit 11 is also driven. In synchronization with the driving of the scanner unit 11, the charging roller 2 in each cartridge uniformly electrically charges the surface of the drum 1 to a predetermined polarity and potential with predetermined control timing. The scanner unit 11 scans (exposes) the surface of each drum 1 with the laser light L modulated correspondingly to the image signal for an associated color. As a result, an electrostatic latent image corresponding to the image signal for the associated color is formed on the surface of the drum 1. The thus formed electrostatic latent image is developed by the developing roller 3*a* into a developer image.

Through the above described electrophotographic image forming process operation, a yellow developer image, which corresponds to the yellow (Y) color component of a full-color image is formed on the drum 1 of the first cartridge PY. The developer image is primary-transferred onto the belt 13. On the drum 1 of the second cartridge PM, a magenta (M) developer image, which corresponds to the magenta component of the full-color image is formed. The developer image is primary-transferred onto the Y developer image, which has been transferred on the belt 13, in a superposition manner. On the drum 1 of the third cartridge PC, a cyan (C) developer image, which corresponds to the cyan component of the full-color image is formed. The developer image is primary-transferred onto the Y and M developer images, which have been transferred on the belt 13, in the superposition manner. On the drum 1 of the fourth cartridge PK, a black (K) developer image, which corresponds to the black component of the full-color image is formed. The developer image is primary-transferred onto the Y, M and C developer images, which have been transferred on the belt 13, in the superposition manner. Thus, an unfixed full-color developer image based on the four colors of Y, M, C and K is synthetically formed on the belt 13. In each cartridge, an untransferred developer remaining on the surface of the drum 1 after the primary transfer of the developer images on the belt 13 is removed by the cleaning means 4.

Meanwhile, the feeding roller 20 is driven with predetermined control timing. As a result, sheets S (recording material) stacked on the tray 19 are separated and fed one by one by cooperation of the roller 20 and the separation pad 21 to be introduced into a nip (secondary transfer nip) between the secondary transfer roller 22 and the belt 13. As a result, onto the surface of the sheet S, the superposed four color developer images are collectively from the belt 13 onto the surface of the sheet S during nip-conveyance of the sheet S in the nip.

The sheet S is separated from the surface of the belt 13 and is then guided into the fixing device 23 to be subjected to heat and pressure in a fixation nip of the fixing device 23. As a result, color mixing of the respective color developer images and fixation thereof on the sheet S are performed. Thereafter, the sheet S is moved out of the fixing device 23, and then is discharged as a full-color image formation product onto the sheet discharge tray 25 by the discharge roller pair 24. In this embodiment, a secondary transfer residual developer remaining on the surface of the belt 13 after the sheet separation is, e.g., at the primary transfer portion of the first process cartridge PY, electrostatically deposited on the surface of the drum 1 and then is removed by the cleaning means 4.

(Cartridge Exchange)

As each of the first to fourth cartridges PY, PM, PC and PK is used for image formation, the developer (toner) stored in the developing means 3 is consumed. For this reason, e.g., the image forming apparatus is provided with a means (not shown) for detecting an amount of the developer remaining in each cartridge. The detected amount of the developer in each cartridge is compared, by a control circuit portion 101, with a threshold value preset for providing a prewarning or warning of the lifetime of the cartridge. When the detected amount of the residual developer in the cartridge is smaller than the preset threshold value, the prewarning or warning of the lifetime of the cartridge is displayed on a display portion (not shown). As a result, the image forming apparatus prompts the user to prepare a cartridge for exchange, or to replace the cartridge with a fresh cartridge, in order to maintain an output image quality.

In this embodiment, the exchange (replacement) of the cartridge with respect to the image forming apparatus is performed through a method in which the cartridge is placed on a pull-out tray 61 as a frame-like movable member and is replaced in a front-access manner in order to improve usability.

This will be described more specifically.

On the front side of the apparatus main assembly A, an opening 30 for permitting passing of the cartridges therethrough is provided in order to insert the cartridges into the apparatus main assembly A and demount the cartridges from the apparatus main assembly A.

The door 31 is as openable member movable between a closed position in which the opening 30 is covered with the door 31 and an open position in which the opening 30 is exposed.

Figure 2:
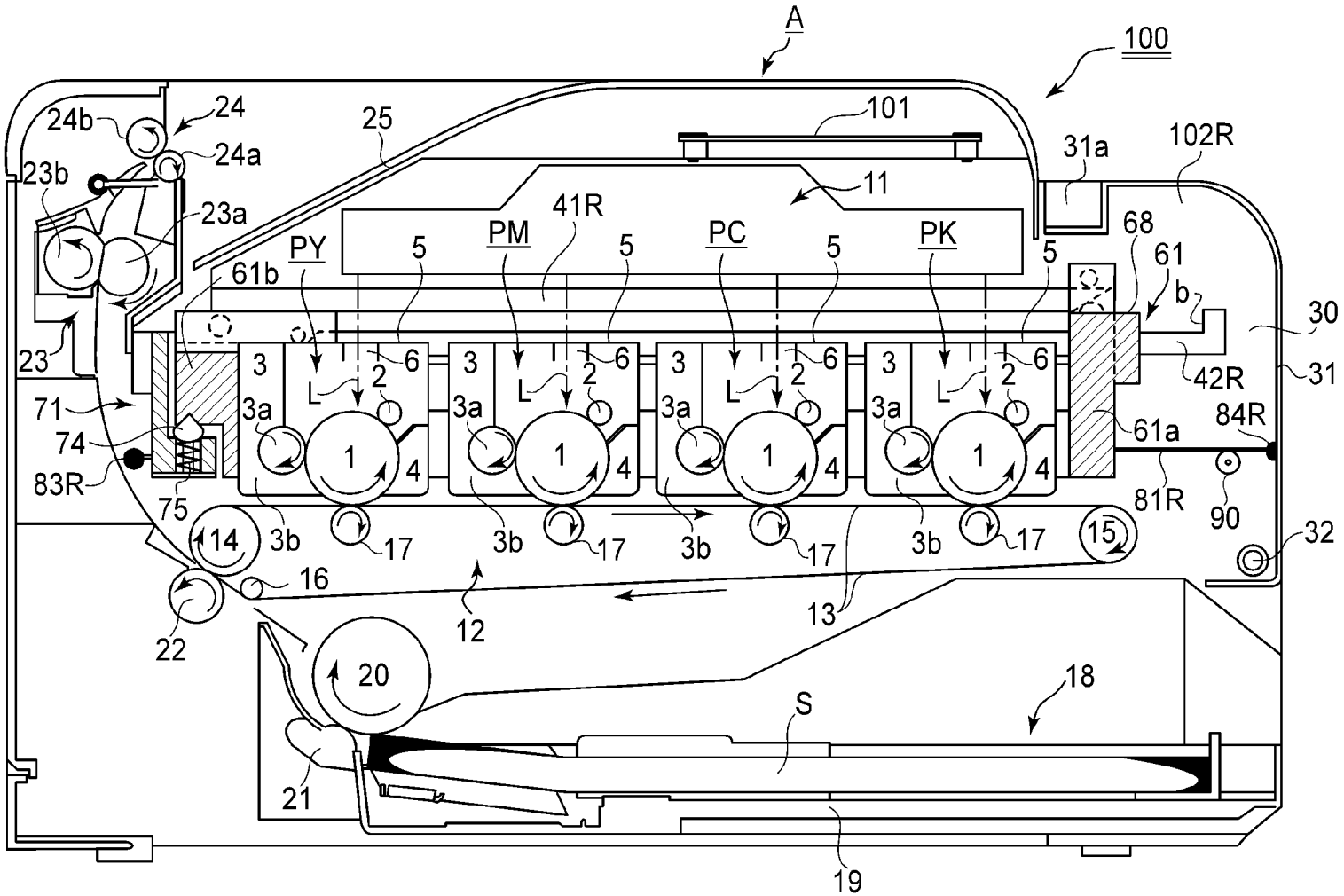
FIG. 2 is a longitudinal left side view of the image forming apparatus.

In this embodiment, the door 31 can be opened and closed and can be rotationally moved relative to the apparatus main assembly A about a horizontal (hinge) shaft 32 provided at a lower portion of the door 31. That is, the door 31 is rotated about the hinge shaft 32 so that it can be moved backward into the closed position (closing operation) to place the opening 30 in a closed (covered) state as shown in FIGS. 1 and 2. By the closing of the door 31, the opening 30 is closed (covered). Further, the door 31 can be rotated forward about the hinge shaft 32 into the open position (opening operation), as shown in FIG. 1, to place the opening 30 in an opened state with respect to the apparatus main assembly A. As a result, the opening 30 is considerably exposed. To the door 31, a holding (grip) portion 31*a* is provided.

Figure 3:
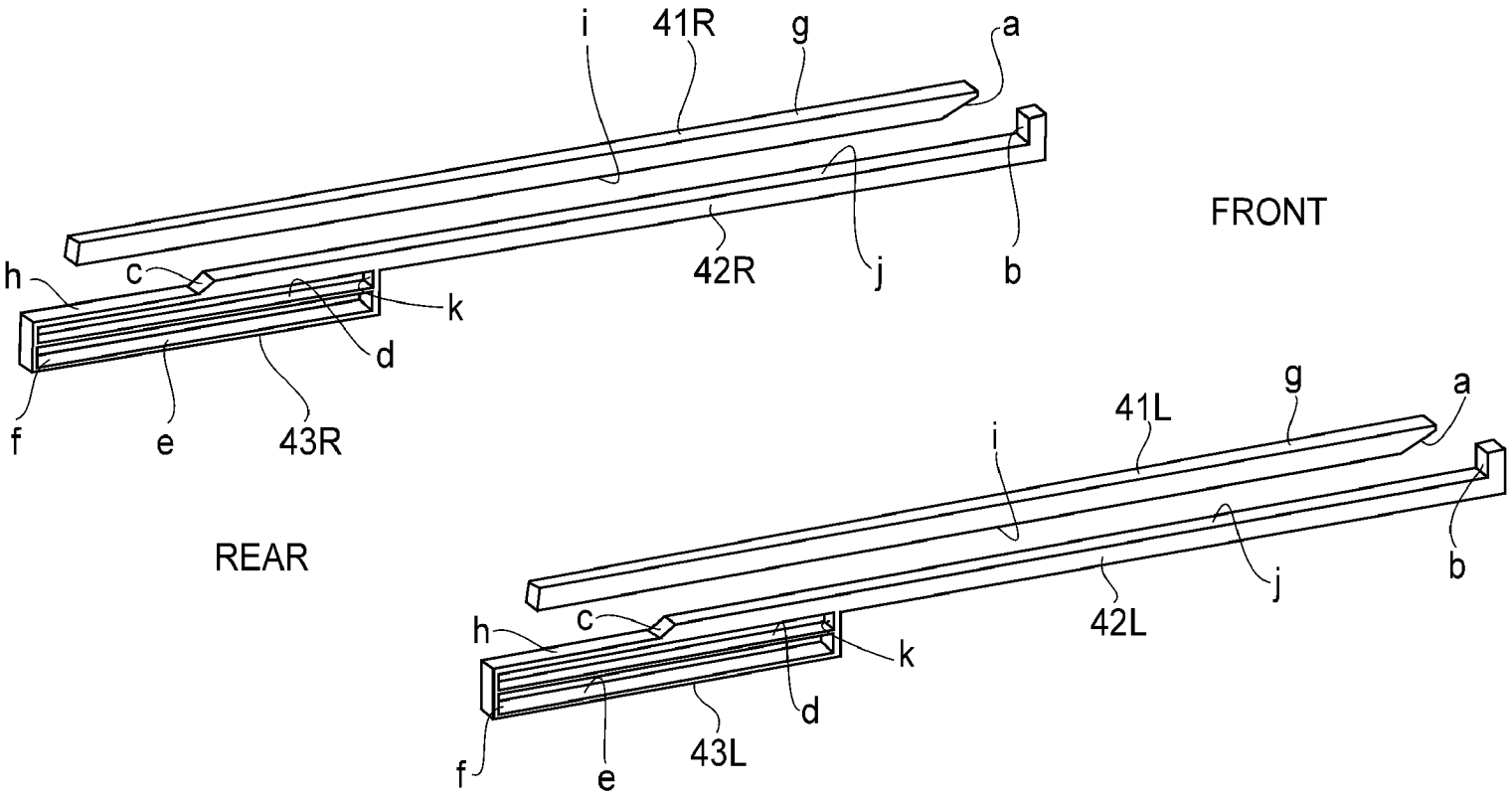
FIG. 3 is a perspective view of a left and right guide rails.

Inside left and right frames 102L and 102R of a main frame of the apparatus main assembly A, left guide rails 41L and 42L and right guide rails 41R and 42R are disposed oppositely to each other in a bilaterally symmetrical manner as shown in FIG. 3. The guide rails 41L and 42L are disposed in parallel vertically and the guide rails 41R and 42R are disposed in parallel vertically. A longitudinal (lengthwise) direction of each of the left and right guide rails 41L, 42L, 41R and 42R coincides with the front-rear direction of the apparatus main assembly A. In FIG. 3, the left frame 102L for the left guide rails 41L and 42L and the right frame 41R and 42R are omitted from illustration.

A forward end portion of each of the left guide rail 41L and the right guide rail 41R is an inclined surface portion a which is upwardly inclined toward the end thereof. A forward end portion of each of the left guide rail 42L and the right guide rail 42R is a hook-shaped portion b which is bent upwardly. A rear end portion of each of the left guide rail 42L and the right guide rail 42R is an inclined surface portion c which is downwardly inclined toward the end thereof. On the rear end portion sides of the left guide rail 42L and the right guide rail 42R, second guide rails (for the slidable member) 43L and 43R are integrally provided, respectively, while extending in the front-rear direction.

Figure 4:
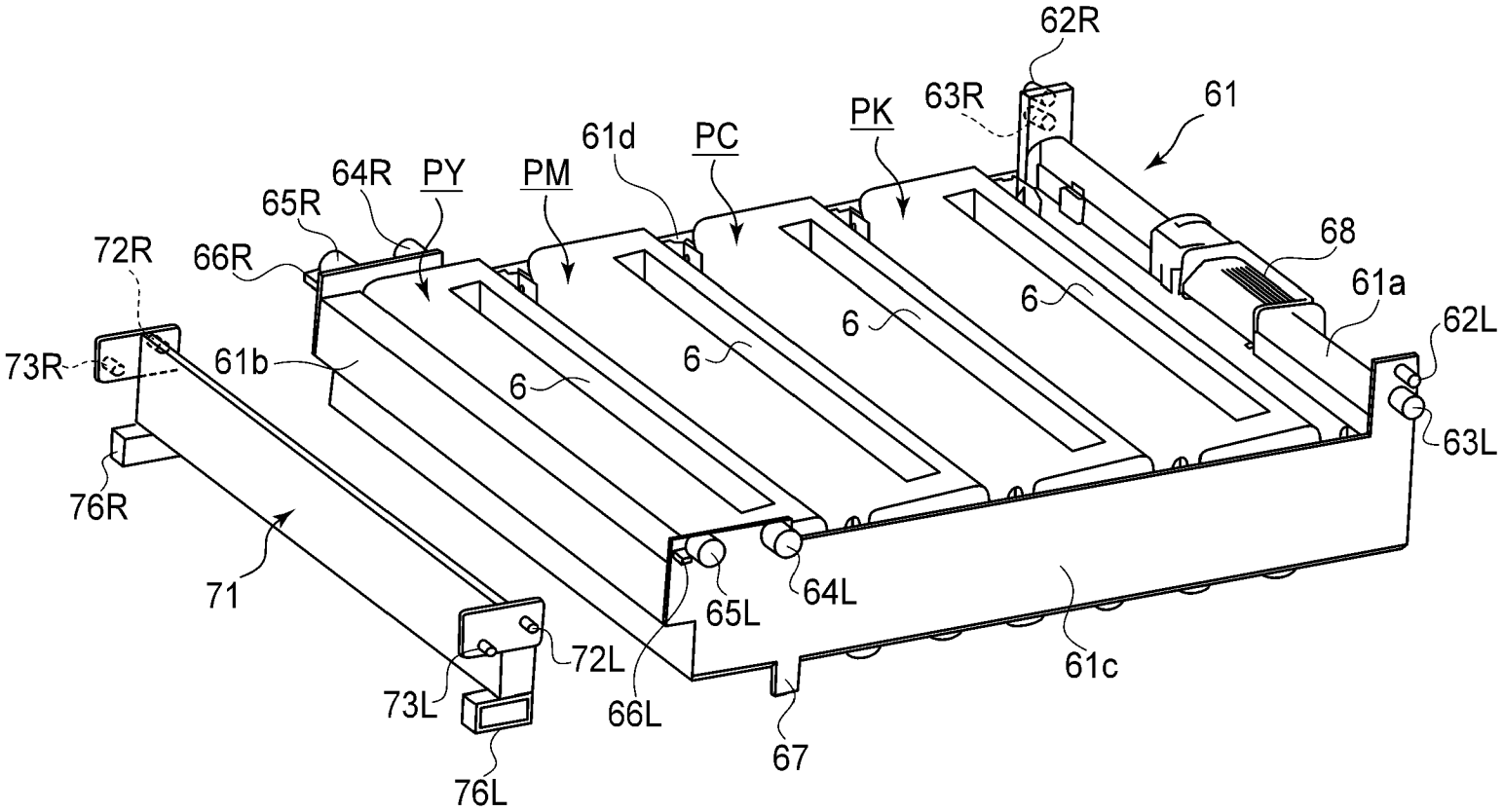
FIG. 4 is a perspective view of a pull-out tray and a slidable member.
Figure 5:
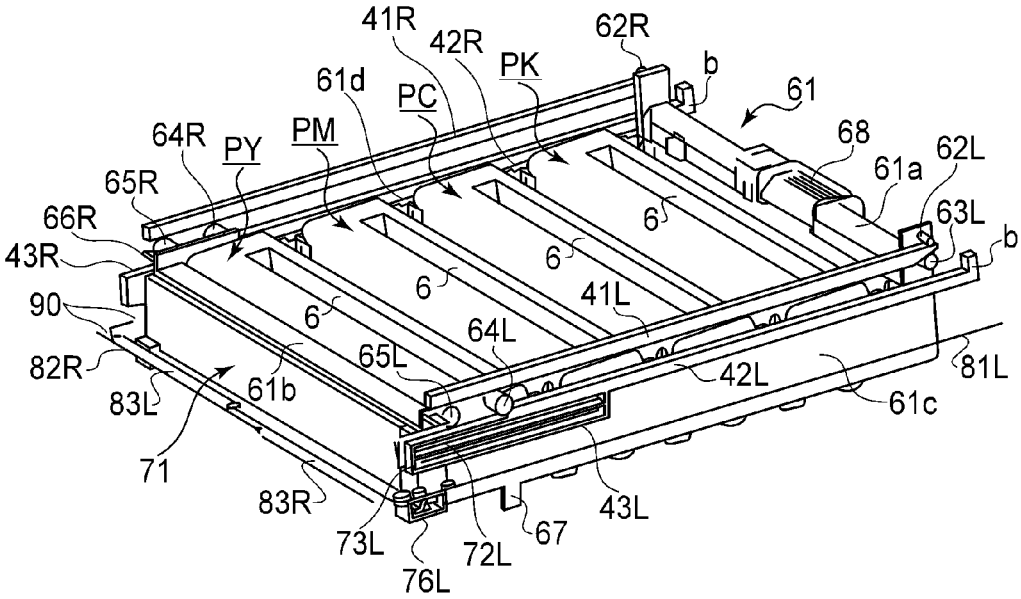
FIG. 5 is a perspective view showing a state in which the pull-out tray is held between the left and right guide rails and the slidable member is held between left and right second guide rails.
Figure 6:
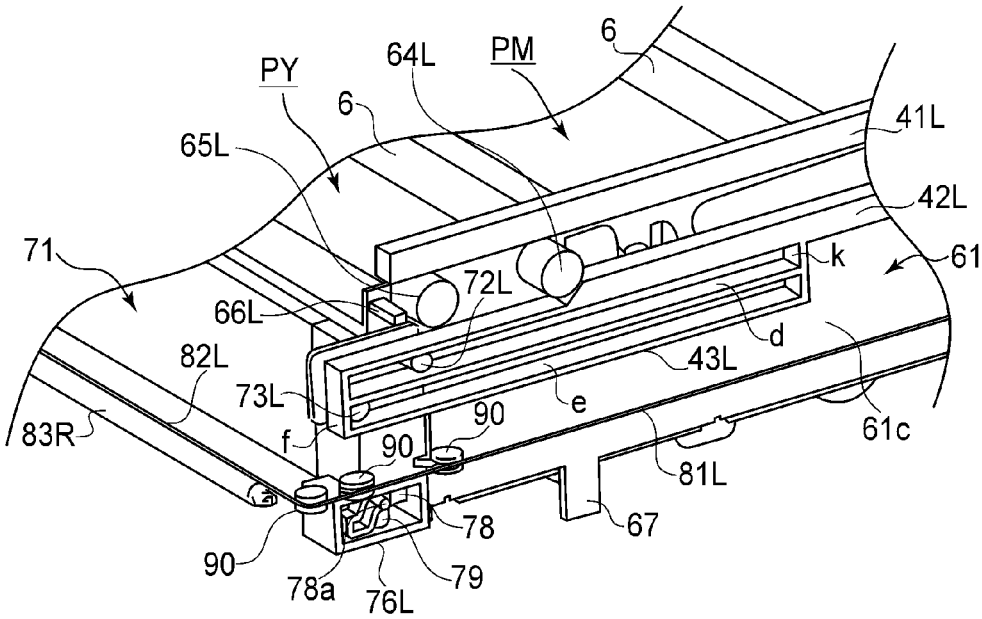
FIG. 6 is a partly enlarged view of FIG. 5.

FIG. 4 is a perspective view of a pull-out tray 61 as a movable member and a slidable member 71. FIG. 5 is a perspective view showing a state in which the tray 61 is held between the left and right guide rails 41L, 42L, 41R and 42R and the slidable member 71 is held between the second guide rails 43L and 43R. FIG. 6 is a partly enlarged view of FIG. 5.

Outside a left frame 61*c* and a right frame 61*d* of the tray 61, first to fourth (four) left rollers 62L, 63L, 64L and 65L and first to fourth (four) right rollers 62R, 63R, 64R and 65R are provided in a bilaterally symmetrical manner. The first rollers 62L and 62R and the second rollers 63L and 63R are vertically spaced and are provided on the front end side of the left frame 61*c* and the right frame 61*d* of the tray 61. The third rollers 64L and 64R and the fourth rollers 65L and 65R are vertically spaced and are provided on the rear end side of the left frame 61*c* and the right frame 61*d* of the tray 61. The left rollers 62L, 63L, 64L and 65L engage with the left guide rails 41L and 42L. The right rollers 62R, 63R, 64R and 65R engage with the right guide rails 41R and 42R. As a result, the tray 61 is horizontally held slidably movable in the front-rear direction between the left and right guide rails 41L, 42L, 41R and 42R.

Further, at left and right outer side surfaces of the slidable member 71, fifth and sixth (two) rollers 72L and 73L and fifth and sixth (two) rollers 72R and 73R are provided in a bilaterally symmetrical manner. The sixth rollers 73L and 73R are located rearward and downward with respect to the fifth rollers 72L and 72R. The left rollers 72L and 73L engage with an upper rail d and a lower rail e, respectively, of the second left guide rail 43L. The right rollers 72R and 73R engage with the upper rail d and the lower rail e, respectively, of the second right guide rail 43R. As a result, the slidable member 71 is horizontally held slidably movable in the front-rear direction between the second left and right guide rails 43L and 43R.

Figure 7:
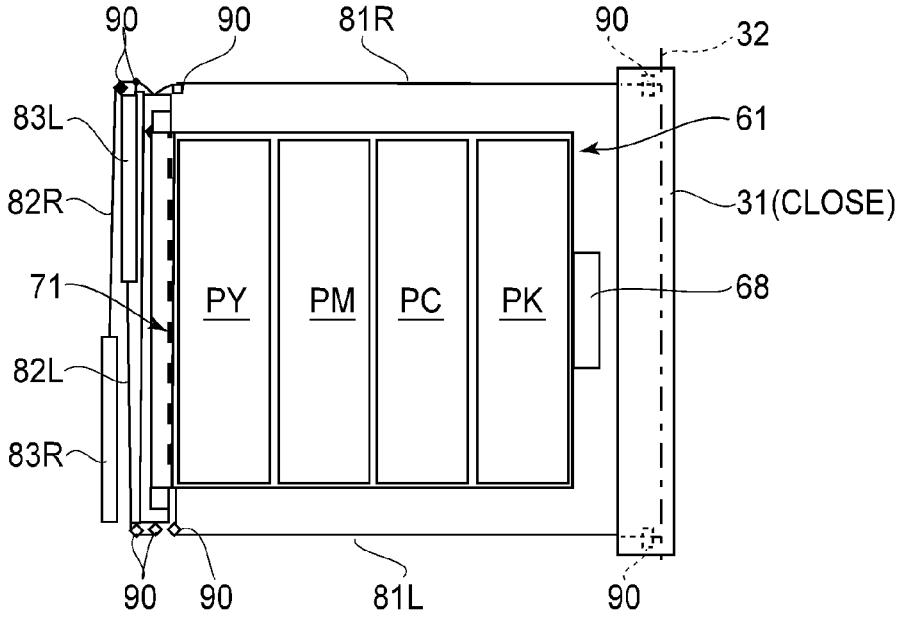
FIGS. 7(*a*) and 7(*b*) are schematic views showing a state of a wire, a damper spring, the slidable member, and the pull-out tray when a door is closed and opened, respectively.
Figure 7:
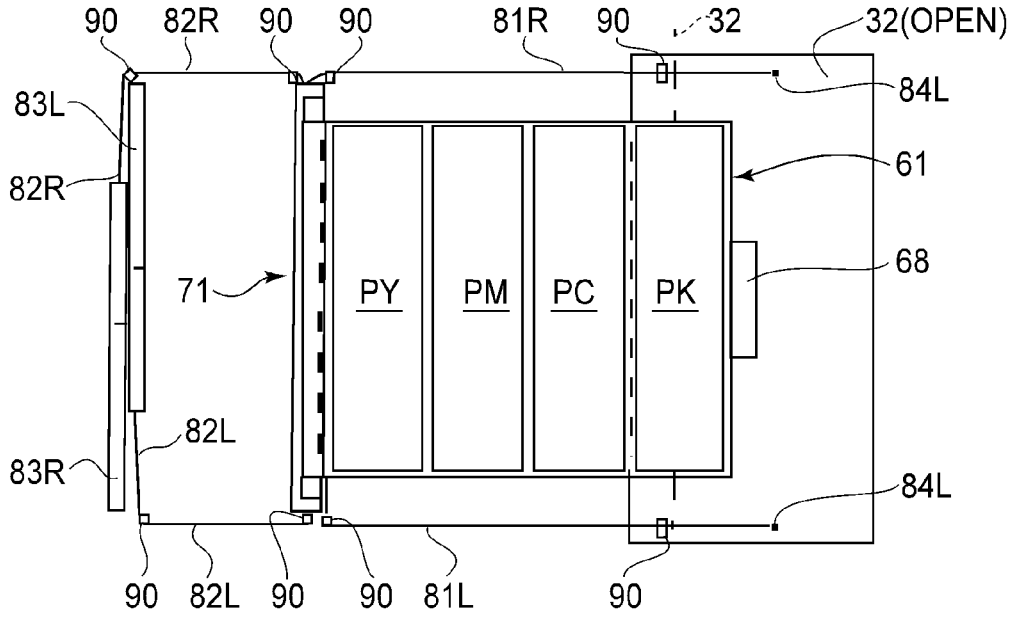

The slidable member 71 is disposed on the rear side of the tray 61. The slidable member 71 and the door 31 are, as shown in FIGS. 7(*a*) and 7(*b*), connected through left and right wires 81L and 81R on the left and right sides. Reference numerals 84L and 84R represent a locking portion between the wire 81L and the door 31 and a locking portion between the wire 81R and the door 31. The slidable member 71 is connected to damper springs (spring members) 83L and 83R through wires 82L and 83R on its left and right sides. A reference numeral 90 represents a guide pulley for extending the wires 81L, 81R, 82L and 82R.

The slidable member 71 includes a stopper member 74 (FIG. 2) for connecting the tray 61. The stopper member 24 is always urged upward by a spring 75, so that an upper end portion thereof is elastically projected. A rear frame 61*b* of the tray 61 is provided with a downwardly recessed portion 61*f* (FIG. 9) engageable with the upper end portion of the stopper member 74. By the engagement between the stopper member 74 and the recessed portion 61*f*, the tray 61 is held connected with respect to the slidable member 71. In this embodiment, the stopper member 74 and the recessed portion 61*f* constitute an engaging member for placing the slidable member 71 and the tray 61 in the connected state and in a disconnected state.

Figure 10:
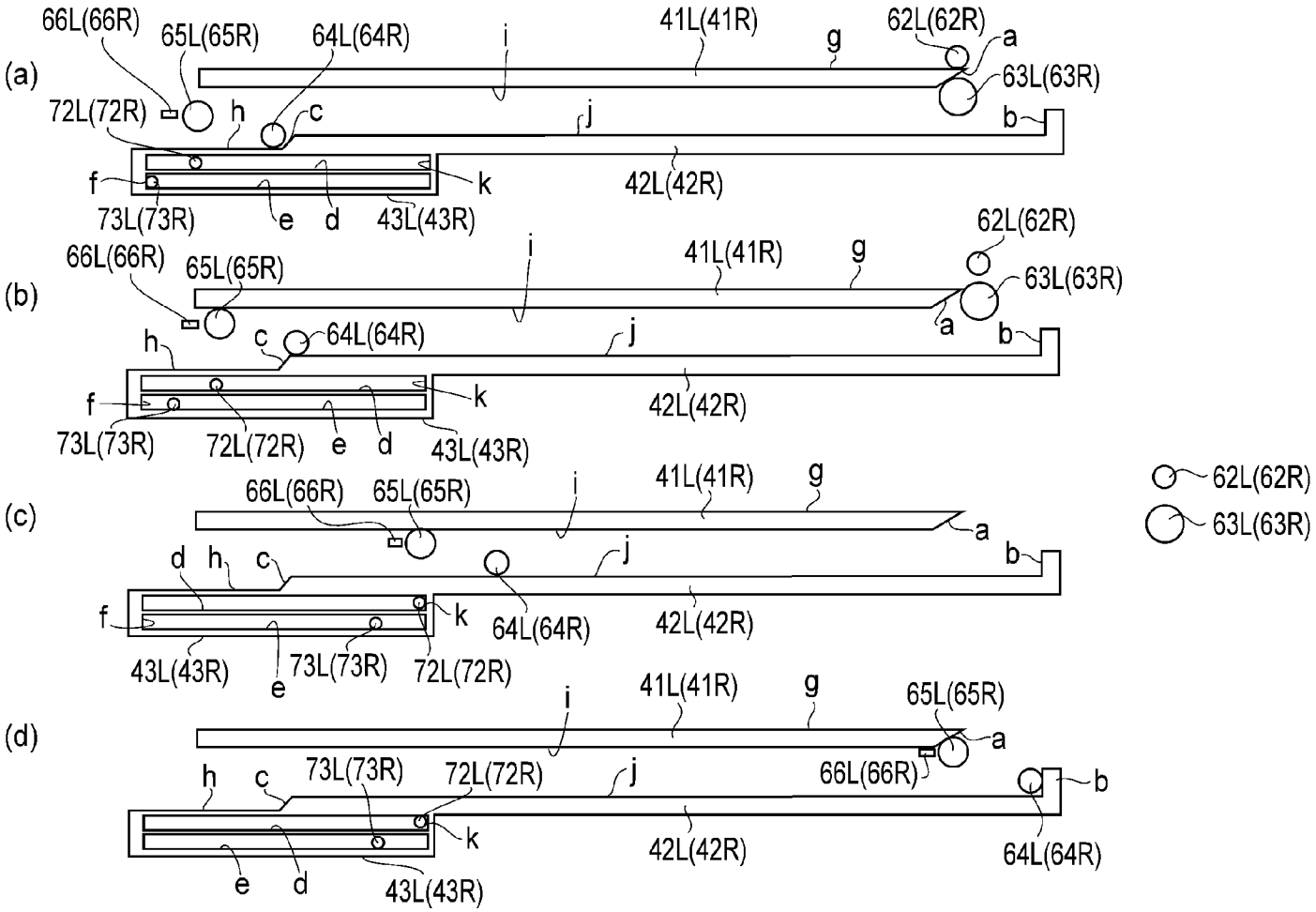
FIGS. 10(*a*) to 10(*d*) show moving positions of first to sixth rollers with respect to the left and right guide rails by opening rotation of the door and movement of the tray to the pulled-out position.

As shown in FIGS. 1 and 2, in a state in which the door 31 is closed with respect to the opening 30 of the apparatus main assembly A, the slidable member 71 is rearwardly pulled through the wires 82L and 82R by a contraction force of the damper springs 83L and 83R to be stopped at a most rearward position shown in FIG. 2. At the most rearward position of the slidable member 71, as shown in FIG. 6 and FIG. 10(*a*), the sixth left roller 73L is stopped by a rear wall f of the lower rail e of the second left guide rail 43L. Further, the sixth right roller 73R is stopped by the rear wall f of the lower rail e of the second right guide rail 43R.

The tray 61 is in the state in which it is connected to the slidable member 71 by the engagement between the stopper member 74 and the recessed portion 61*f*, thus being located at an inside position (image forming position or transfer contact position) corresponding to the most rearward position of the slidable member 71.

In the state in which the tray 61 is located at the inside position, the first rollers 62L and 62R are placed on the front end portion of the upper guide rails 41L and 41R on their upper surface g sides as shown in FIG. 10(*a*). The third rollers 64L and 64R are located between the rear inclined surface portion c of the lower guide rails 42L and 42R and an upper surface h of the second guide rails 43L and 43R and are placed on the upper surface h of the second guide rails 43L and 43R. As a result, the tray 61 is held with a horizontal attitude between the left and right guide rails 41L, 42L, 41R and 42R. The second rollers 63L and 63R are located in contact with the front inclined surface portion a of the upper guide rails 41L and 41R. As a result, the tray 61 is prevented from being further moved rearwardly to be positioned. The fourth rollers 65L and 65R are located between a lower surface i of the upper guide rails 41L and 41R and the upper surface h of the second guide rails 43L and 43R.

In the state in which the tray 61 is located at the inside position, the drum 1 of each of the cartridges PY, PM, PC and PK contacts the belt 13. Further, in the state in which the tray 61 is located at the inside position and the door 31 is closed, each of the cartridges PY, PM, PC and PK is urged by the urging member (not shown) and is fixed to a predetermined positioning portion of the apparatus main assembly A, thus being held at the set position. As a result, the drum 1 of each of the cartridges PY, PM, PC and PK stably contacts the belt 13 in a predetermined manner. Further, to a drive input portion (not shown) of the cartridge, a drive output portion (not shown) of the apparatus main assembly A is connected. Further, to an electric contact of the cartridge, an electric power supplying system (not shown) of the apparatus main assembly A is electrically connected. In this state, the image forming apparatus is capable of performing the image forming operation.

From the above-described state, the pulling out of the tray 61 and the exchange of the cartridge are performed in the following manner.

Figure 8:
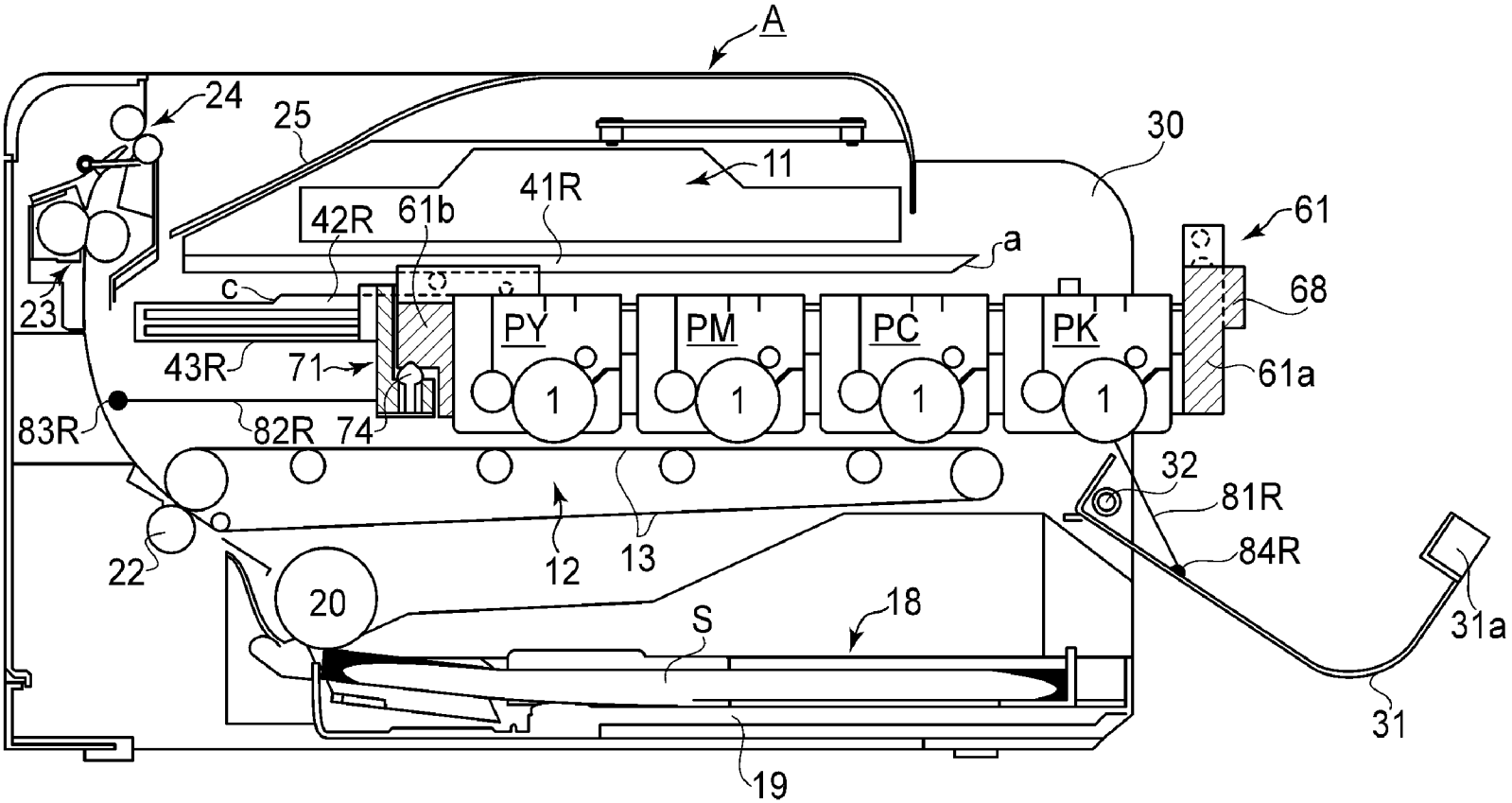
FIG. 8 is a longitudinal left side view of the image forming apparatus in a state in which the door is sufficiently opened.

(1) The closed door 31 is, as shown by a chain double-dashed line in FIG. 1 or as shown in FIG. 8, sufficiently opened and rotated about a lateral (horizontal) shaft 32 to a rotation end point. By an operation of an interrelating mechanism (not shown) performed in interrelation with the opening operation of the door 31, the connection of the drive output portion of the apparatus main assembly A to the drive input portion of each of the cartridges PY, PM, PC and PK is released (drive release). Further, the urging by the urging member which positions and fixes each cartridge is released (urging release). Further, the electrical connection of the electric power supplying system of the apparatus main assembly A to the electrical contact of each cartridge is released (electric power supply release).

(2) By further opening rotation of the door 31, the wires 81L and 81R are pulled. As a result, the slidable member 71 located at the most rearward position moves forward along the second guide rails 43L and 43R while stretching the damper springs 83L and 83R through the wires 82L and 82R. Correspondingly, the tray 61 placed in the connected state with respect to the slidable member 71 by the engaging members 74 and 61*f* is also moved forward together with the slidable member 71.

(3) At an initial stage of the forward movement of the tray 61, the third rollers 64L and 64R climb the rear upward inclined surface portion c of the lower guide rails 42L and 42R to reach the upper surface j of the lower guide rails 42L and 42R as shown in FIG. 10(*b*). Further, the fourth rollers 65L and 65R contact a lower surface i of the upper guide rails 41L and 41R. The first rollers 62L and 62R are separated forward and upward from the front end of the upper surface g of the upper guide rails 41L and 41R. The second rollers 63L and 63R are separated forward from the front downward inclined surface portion a of the upper guide rails 41L and 41R.

In this state, the third rollers 64L and 64R contact the upper surface j of the lower guide rails 42L and 42R, and the fourth rollers 65L and 65R contacts the lower surface i of the upper guide rails 41L and 41R. As a result, even when the first rollers 62L and 62R are separated forward and upward from the front end of the upper surface g of the upper guide rails 41L and 41R, the tray 61 is horizontally held between the left and right guide rails 41L, 42L, 41R and 42R. The tray 61 is upwardly moved from a level of the upper surface h of the second guide rails 43L and 43R to a level of the upper surface j of the lower guide rails 42L and 42R. By the upward movement of the tray 61, each of the cartridges PY, PM, PC and PK is also upwardly moved together with the tray 61, so that the drum 1 of each of the cartridges PY, PM, PC and PK is upwardly separated from the belt 13.

The connected state of the tray 71 with respect to the slidable member 71 by the stopper member 74 and the recessed portion 61*f* as the engaging member is, even when the tray 61 is upwardly moved as described above, retained by the upward movement of the stopper member 74 following the tray 61.

(4) The wires 81L and 81R are pulled by further opening rotational movement of the door 31, so that the slidable member 71 is moved forward along the second guide rails 43L and 43R. As a result, the tray 61 is also moved forward further along the guide rails 41L, 42L, 41R and 42R by being pushed by the slidable member 81 while keeping the horizontal attitude. During this movement, the drum 1 of each of the cartridges PY, PM, PC and PK and the belt 13 are separated from each other, so that the friction therebetween is not caused to occur.

(5) When the door 31 is sufficiently opened to a rotational movement end point, the slidable member 71 reaches a forwardest position. At the forwardest position of the slidable member 71, as shown in FIG. 10(*c*), the fifth left roller 72L is stopped by a front wall k of the upper rail d of the second left guide rail 43L and the fifth right roller 72R is stopped by the first wall k of the upper rail d of the second right guide rail 43R.

In the state in which the door 31 is sufficiently opened to the rotational movement end point to move the slidable member 71 to the forwardest position, the tray 61 is placed in a state in which a front frame 61*a* having passed through the exposed opening 30 is located outside the apparatus main assembly A as shown in FIG. 8. That is, a part of the tray 61 has passed through the opening 30 and is placed in a state in which it is exposed outside the apparatus main assembly A.

In the state in which the door 31 is sufficiently opened to the rotational movement end point, rotational movement moment of the door 31 about the hinge shaft 32 in the opening direction by the weight of the door 31 is larger than a pullback force of the damper springs 83L and 83R with respect to the slidable member 71. As a result, the opened state of the door 31 is kept stably even when the user moves his (her) hand off the opened door 31.

In the state of FIG. 8, the user grips a grip portion 68 provided to the front surface of the front frame 61*a* of the tray 61 and applies a force in a direction in which the tray 61 is pulled forward. As a result, the stopper member 74 on the slidable member 71 side is pushed by an inclined surface portion of the recessed portion 61*f* on the tray 61 side to move downward against the upward urging force by the spring 75, thus being disengaged from the recessed portion 61*f*. That is, the tray 61 is disengaged from the slidable member 71. When the stopper member 74 is disengaged from the recessed portion 61*f*, the stopper member 74 is restored to the state in which it is pushed upward by the upward urging force by the spring 75.

(6) When the tray 61 is further pulled forward, left and right locking mechanisms 76L and 76R (FIGS. 4, 5 and 6) provided on the left and right sides of the slidable member 71 in the bilaterally symmetrical manner are actuated, so that the slidable member 71 located at the forwardest position is fixed (locked) to the apparatus main assembly A.

Figure 11:
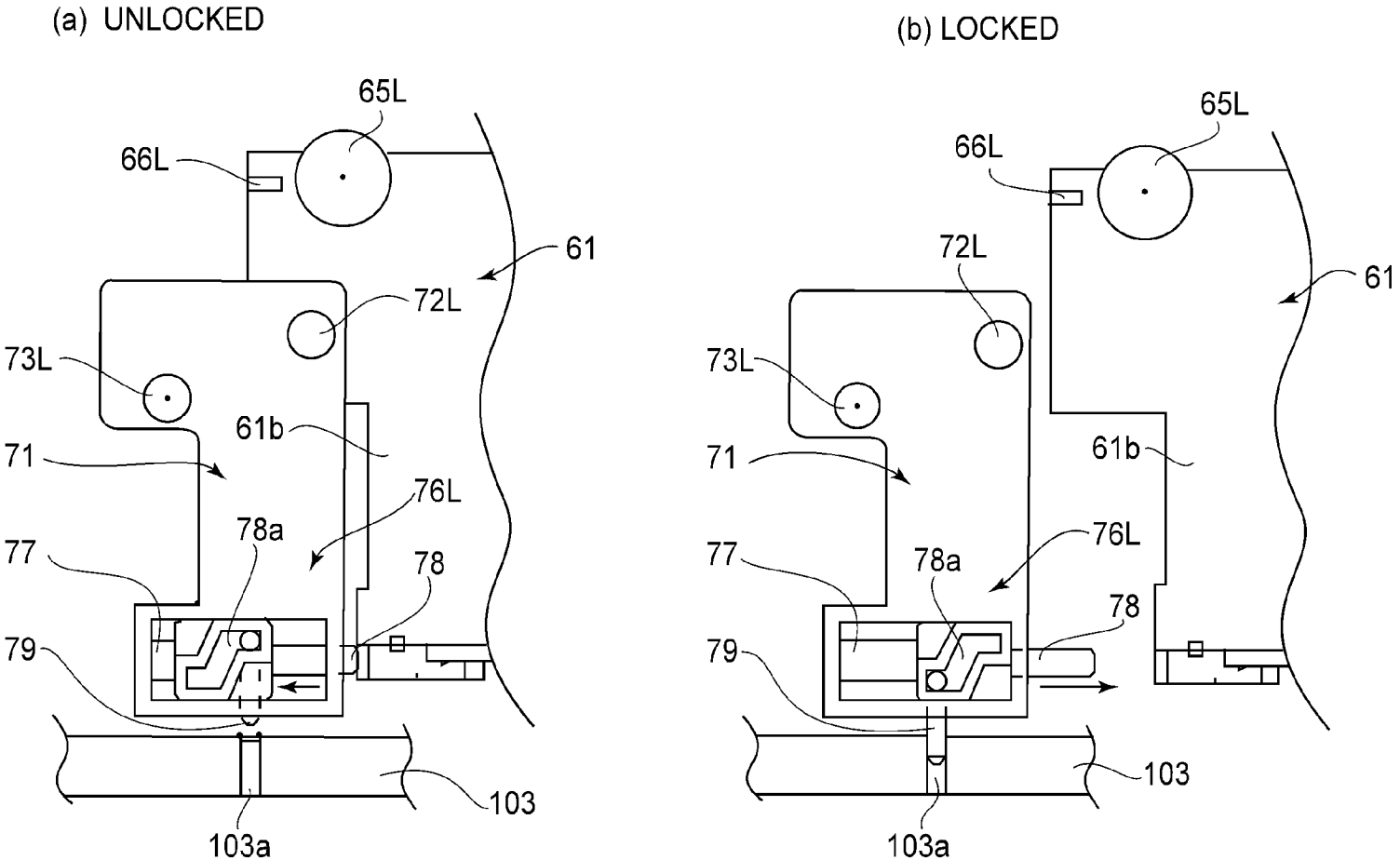
FIGS. 11(*a*) and 11(*b*) are schematic views for illustrating a locking mechanism.

A constitution and operation of these locking mechanisms 76L and 76R will be described with reference to FIGS. 11(*a*) and 11(*b*). FIGS. 11(*a*) and 11(*b*) show the left locking mechanism 76L but the constitution and operation of the right locking mechanism 76R are the same as those of the left locking mechanism 76L. The locking mechanism 76L (76R) includes a rod member 78 moved and urged forward by a spring 77 and a locking member 79 moving upward and downward by backward movement and forward movement of the rod member 78. The rod member 78 is held at the position shown in FIG. 11(*a*) in the state in which the tray 61 is connected to the slidable member 71 by the engagement between the stopper member 74 and the recessed portion 61*f*. That is, the rod member 78 is located at a retracted position in a state in which a front end portion thereof is pressed by the outer surface of the rear frame 61*b* of the tray 61 to contract the spring 77. When the rod member 78 is moved to the retracted position, the stopper member 74 is located and held at an upper portion of an inclined surface cam 78*a* of the rod member 78. As a result, the stopper member 74 is held in an unlocked state in which the stopper member 74 is moved upward inside the locking mechanism 76L (76R).

Thus, in the state in which the slidable member 71 is moved to the forwardest position, the tray 61 is pulled out forward, so that the stopper member 74 and the recessed portion 61*f* are disengaged to disconnect the tray 61 from the slidable member 71, thus moving the tray 61 forward. As a result, the pressing of the locking member 79 by the outer surface of the rear frame 61*b* of the tray 61 is released, so that the locking member 79 is placed in a state in which it is moved to an advancing position by a thrusting force of the spring 77 as shown in FIG. 11(*b*). When the rod member 78 is moved to the advancing position, the stopper member 74 is located and held at a lower portion of the inclined surface cam 78*a* of the rod member 78. As a result, the stopper member 74 is moved downward from the inside to the outside of the locking mechanism 76L (76R), so that the lower end portion of the stopper member 74 enters and engages with a hole 103*a* of a stay member 103 of the apparatus main assembly A. That is, the slidable member 71 is fixed (locked) to the apparatus main assembly A at the forwardest position (FIGS. 8 and 9).

(7) When the tray 61 is sufficiently pulled out further forward to the pulled-out position, as shown in FIG. 10(*d*), the third rollers 64L and 64R reach the hook-shaped portion b of the front end portion of the lower guide rails 42L and 42R, thus contacting the hook-shaped portion b to be prevented from being moved. Further, the tray 61 is somewhat rotated downward, by its own weight, about the third rollers 64L and 64R prevented from being moved by the hook-shaped portion b. By this rotation, the fourth rollers 65L and 65R contact the front upward inclined surface portion a of the upper guide rails 41L and 41R. Further, projections 66L and 66R provided at a rearward position of the fourth rollers 65L and 65R contact the lower surface i of the upper guide rails 41L and 41R. As a result, even when the user moves his (her) hand off the grip portion 68, the tray 61 is stably held in the pulled-out position from the apparatus main assembly A. FIG. 9 shows the state in which the tray 61 is pulled out to the pulled-out position. In this state, when the door 31 is intended to be closed, the door 31 interferes with a projected portion 67 of the tray 61, so that the door 31 cannot be closed.

Figure 9:
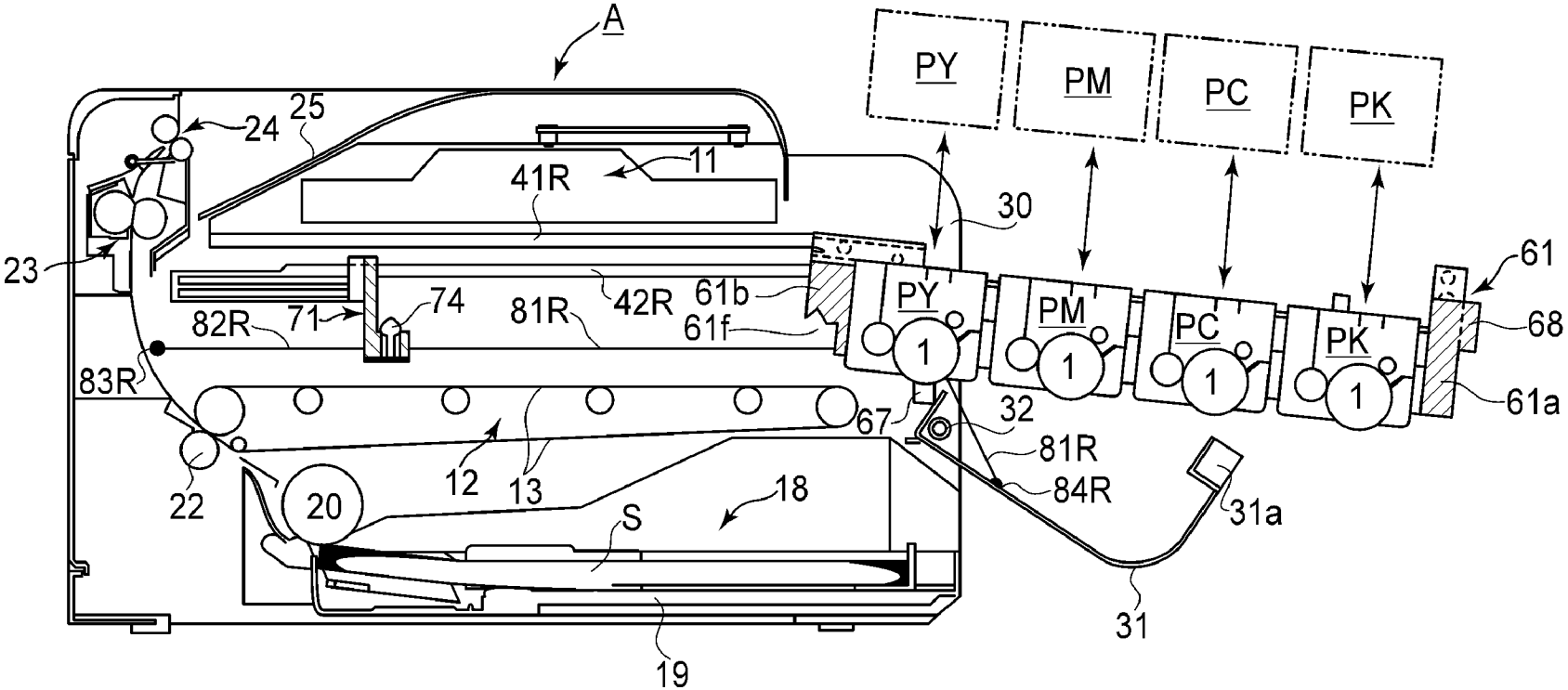
FIG. 9 is a longitudinal left side view of the image forming apparatus in a state in which the pull-out tray is pulled out to the pulled-out position.

(8) The tray 61 supports the plurality of cartridges PY, PM, PC and PK so that they can be demounted successively from the downstream cartridge with respect to the movement direction of the tray 61 during the movement of the tray 61 from the position of FIG. 8 to the pulled-out position of FIG. 9. At the pulled-out position of FIG. 9, all the plurality of cartridges PY, PC, PC and PK are demountable. That is, the entire first to fourth (four) cartridges PY, PM, PC and PK held by the tray 61 pass through the opening 30 and then are exposed outside the apparatus main assembly A, so that the upper surfaces of all the cartridges PY, PM, PC and PK are exposed.

The tray 61 supports the individual cartridges so as to be upwardly demountable. Further, the tray 61 supports the individual cartridges by moving the cartridges downwardly. A used cartridge to be exchanged of the cartridges is raised and demounted upwardly from the tray 61 as shown by the chain double-dashed line in FIG. 9. Then, a fresh cartridge is placed and engaged in the tray 61 from above. That is, the tray 61 is configured to move horizontally to reach the pulled-out position of FIG. 9 at which the tray 61 supports the cartridges so as to be upwardly demountable and by moving the cartridges downwardly. As a result, it is possible to provide the image forming apparatus improved in operativity for inserting the cartridges into the tray 61.

(9) When the cartridge to be exchanged of the cartridges held in the tray 61 is exchanged, the user grips the grip portion 68 of the tray 61 placed in the pulled-out state and pushes and moves the tray 61 into the apparatus main assembly A. As a result, the fourth rollers 65L and 65R move toward the lower side of the front upward inclined surface portion a of the upper guide rails 41L and 41R to reach the lower surface i of the upper guide rails 41L and 41R. Then, the tray 61 is upwardly rotated about the third rollers 64L and 64R which are prevented from being moved by the hook-shaped portion b, thus being placed in the horizontal attitude in parallel to the guide rails 41L, 42L, 41R and 42R. Further, the tray 61 is placed in the horizontal attitude, so that the contact of the projected portions 66L and 66R with the lower surfaces i of the guide rails 41L, 42L, 41R and 42R is released. In this state, the third rollers 64L and 64R contact the upper surface i of the lower guide rails 42L and 42R, and the fourth rollers 65L and 65R contact the lower surface of the upper guide rails 41L and 41R. As a result, the tray 61 is horizontally held between the left and right guide rails 41L, 42L, 41R and 42R and is movable along the guide rails 41L, 42L, 41R and 42R.

(10) The tray 61 with the horizontal attitude is pushed into the apparatus main assembly A along the guide rails 41L, 42L, 41R and 43R. Also during this pushing movement of the tray 61, the drum 1 of each of the cartridges PY, PM, PC and PK and the belt 13 are separated from each other, so that the friction therebetween is not caused to occur.

When the tray 61 is further pushed in, the tray 61 reaches the position of the slidable member 71 which is located at the forwardest position and is fixed to the apparatus main assembly A by the locking mechanisms 76L and 76R. Then, the outer surface of the rear frame 61*b* of the tray 61 urges and moves the rod member 78 of the locking mechanisms 76L and 76R to the retracted position against the thrusting force of the spring 77. As a result, the stopper member 74 is moved upwardly inside the locking mechanism 76L (76R), so that the lower end portion thereof comes out of the hole 103*a* of the stay member 103 on the apparatus main assembly A side. That is, the fixing of the slidable member 71 to the apparatus main assembly A at the forwardest position is released. Substantially simultaneously with this fixing release, the stopper member 74 on the slidable member 71 side is urged by the inclined surface portion of the recessed portion 61*f* on the tray 61 side, thus being moved downwardly against the upward urging force by the spring 75. When the tray 61 is further pushed in, the stopper member 74 and the recessed portion 61*f* are engaged with each other, so that the tray 61 is connected to the slidable member 71. The stopper member 74 is upwardly urged by the spring 75. That is, the tray 61 is placed in the state shown in FIG. 8.

(11) Then, from the state of FIG. 8, the door 31 is rotated and closed. By this rotation, the slidable member 71 is moved backward through the wires 82L and 82R due to the contracting force of the damper springs 83L and 83R placed in the expanded state as shown in FIG. 7(*b*). That is, the slidable member 71 is moved backward from the forwardest position to the most rearward (backward) position. Then, by the engagement of the stopper member 74 with the recessed portion 61*f*, the tray 61 connected to the slidable member 71 is also moved backward together with the slidable member 71.

At the time before the door 31 is completely closed, the third rollers 64L and 64R descend the rear downward inclined surface portion of the lower guide rails 42L and 42R as shown in FIG. 10(*a*). That is, the third rollers 64L and 64R are located between the rear inclined surface portion c of the lower guide rails 42L and 42R and an upper surface h of the second guide rails 43L and 43R and are placed on the upper surface h of the second guide rails 43L and 43R. The first rollers 62L and 62R are placed on the front end portion of the upper surface g of the upper guide rails 41L and 41R. The second rollers 63L and 63R are located in contact with the front inclined surface portion a of the upper guide rails 41L and 41R. The fourth rollers 65L and 65R are located between a lower surface i of the upper guide rails 41L and 41R and the upper surface h of the second guide rails 43L and 43R. In this state, the tray 61 is connected to the slidable member 71 by the engagement between the stopper member 74 and the recessed portion 61*f* and is located at the inside position corresponding to the most rearward position of the slidable member 71. That is, the drum 1 of each of the cartridges PY, PM, PC and PK contacts the belt 13.

(12) By an operation of an interrelating mechanism (not shown) performed in interrelation with a final period rotation of the closing operation of the door 31, each of the cartridges PY, PM, PC and PK is urged by the urging member (not shown) and is held in the state in which it is fixed to a predetermined positioning portion of the apparatus main assembly A. As a result, the drum 1 of each of the cartridges PY, PM, PC and PK stably contacts the belt 13 in a predetermined manner. Further, to a drive input portion (not shown) of the cartridge, a drive output portion (not shown) of the apparatus main assembly A is connected. Further, to an electric contact of the cartridge, an electric power supplying system (not shown) of the apparatus main assembly A is electrically connected. In the state in which the door 31 is sufficiently closed, the image forming apparatus is capable of performing the image forming operation.

The damper springs 83L and 83R not only have the function of drawing the slidable member 71 and the tray 61 to the inside position by the damper spring force but also permit smooth opening and closing operations of the door 31.

As described above, according to this embodiment, a part of the tray 61 is caused to pass through the opening 30 to be located outside the apparatus main assembly A by placing the door 31 in the open state, so that the presence of the tray 61 is more recognizable by the user.

Further, in the case where the tray 61 is accommodated in the apparatus main assembly A, only by the closing operation of the door 31, the tray 61 can be set in a state in which an image can be formed (in a printable state).

In the case where the tray 61 is stopped at a position in which it is not engaged with the stopper member 74 and then the door 31 is intended to be closed, the slidable member 71 is fixed to the locking member 74 at the apparatus main assembly-side hole 103*a*, so that the slidable member 71 is not moved until the tray 61 moves to the position of FIG. 8.

The constitution of the image forming apparatus 100 of Embodiment 1 described above is summarized as follows.

The image forming apparatus forms the image on the recording material S. The image forming apparatus includes the opening 30 provided to the apparatus main assembly A of the image forming apparatus. The image forming apparatus includes the openable member 31 movable between the closed position in which the opening 30 is covered and the open position in which the opening 30 is exposed and includes the movable member 61 which supports the plurality of cartridges, side by side, each including at least one of the image bearing member 1 on which the latent image is to be formed and the developing means 3 for developing with the developer the latent image formed on the image bearing member 1. The movable member 61 is a member capable of taking the inside position in which the cartridges are located inside the apparatus main assembly A and the pulled-out position in which the movable member 61 having passed through the opening 30 is pulled out to the outside of the apparatus main assembly A and in which the cartridges are demountable from and mountable to the movable member 1 outside the apparatus main assembly A. When the opening operation of the openable member 31 is performed, the movable member 61 is moved toward the pulled-out position, so that the part of the cartridges supported by the movable member 61 passes through the opening 30 to be exposed outside the apparatus main assembly A.

After the movable member 61 is moved from the exposed position to the inside position, the closing operation of the openable member 31 can be performed.

Further, the image forming apparatus includes the slidable member 71 movable in the same direction as the movement direction of the movable member 61. The slidable member 71 is connected to the openable member 31 through the connecting member 81 and is moved toward the pulled-out position by the opening operation of the openable member 31 and moved toward the inside position by the closing operation of the openable member 31. The image forming apparatus further includes the engaging members 74 and 61*f* for connecting and disconnecting the slidable member 71 and the movable member 61. When the opening operation of the openable member 31 is performed, the movable member 61 connected to the slidable member 71 by the engaging members 74 and 61*f* is moved toward the pulled-out position together with the slidable member 71. As a result, the part of the movable member 61 passes through the opening 30 and is placed in the state in which it is exposed outside the apparatus main assembly A. Further, when the closing operation of the openable member 31 is performed, the openable member 31 is not stopped until the movable member 61 disconnected from the slidable member 71 is connected to the slidable member 71 by the engaging members 74 and 61*f*. Further, the image forming apparatus includes the spring member 83 for moving and urging the slidable member 71 toward the inside position. The movable member 61 is movable in the direction perpendicular to the longitudinal direction of the image bearing member 1 or the developing means 3 of each of the cartridges supported thereby. The movable member 61 is, in its movement direction, capable of supporting the plurality of cartridges PY, PM, PC and PK side by side.

The movable member 61 supports the plurality of cartridges PY, PM, PC and PK so that the cartridges can be successively demountable from the most downstream cartridge with respect to the movement direction of the movable member 61 during the movement of the movable member 61 from the inside position to the pulled-out position. At the pulled-out position, all the plurality of cartridges are demountable. The movable member 61 supports the cartridges so as to be demountable upwardly and supports the cartridges by moving the cartridges downwardly.

[Embodiment 2]

Embodiment 2 will be described with reference to FIGS. 12 to 15(*b*). Incidentally, constitutional members or portions common to those for the image forming apparatus in Embodiment 1 described above are represented by the same reference numerals or symbols, thus being omitted from redundant explanation.

In the image forming apparatus 100 in this embodiment, the slidable member 71 and the tray 61 as the movable member are disposed so as to move in an obliquely downward direction toward the inside position by their own weights in a free state. That is, compared with the image forming apparatus 100 in Embodiment 1, the belt unit 12 of the image forming apparatus in this embodiment is disposed in a state in which the upper portion of the belt 13 is upwardly inclined toward the front side at an angle of a degrees with respect to a horizontal direction H. Correspondingly, the left and right guide rails 41L, 42L, 41R and 42R are also disposed in the state in which they are upwardly inclined toward the front side at the angle of a degrees with respect to the horizontal direction H. Further, the second guide rails 43L and 43R are also disposed in the state in which they are upwardly inclined toward the front side at the angle of a degrees with respect to the horizontal direction H.

The constitutions of the tray 61 and the left and right guide rails 41L, 42L, 41R and 42R in this embodiment are similar to those in Embodiment 1. The left rollers 62L, 63L, 64L and 65L of the tray 61 engage with the left guide rails 41L and 42L. The right rollers 62R, 63R, 64R and 65R engage with the right guide rails 41R and 42R. As a result, the tray 61 is held slidably movable in the front-rear direction between the left and right guide rails 41L, 42L, 41R and 42R.

The slidable member 71 and the left and right second guide rails 43L and 43R also have the same constitutions as those for the image forming apparatus 100 in Embodiment 1. The left rollers 72L and 73L engage with an upper rail d and a lower rail e, respectively, of the second left guide rail 43L. The right rollers 72R and 73R engage with the upper rail d and the lower rail e, respectively, of the second right guide rail 43R. As a result, the slidable member 71 is held slidably movable in the front-rear direction between the second left and right guide rails 43L and 43R.

In this embodiment, as described above, the left and right guide rails 41L, 42L, 41R and 42R and the second guide rails 43L and 43R are upwardly inclined toward the front side at the angle of a degrees with respect to the horizontal direction H. As a result, the slidable member 71 and the tray 61 as the movable member are moved in the obliquely downward direction toward the inside position by their own weight in the free state. Therefore, in this embodiment, the damper springs 83L and 83R as the spring member for moving and urging the slidable member 71 toward the inside position are not employed. Further, the locking mechanisms 76L and 76R are also not employed. Other constitutions are similar to those of the image forming apparatus 100 in Embodiment 1.

Figure 12:
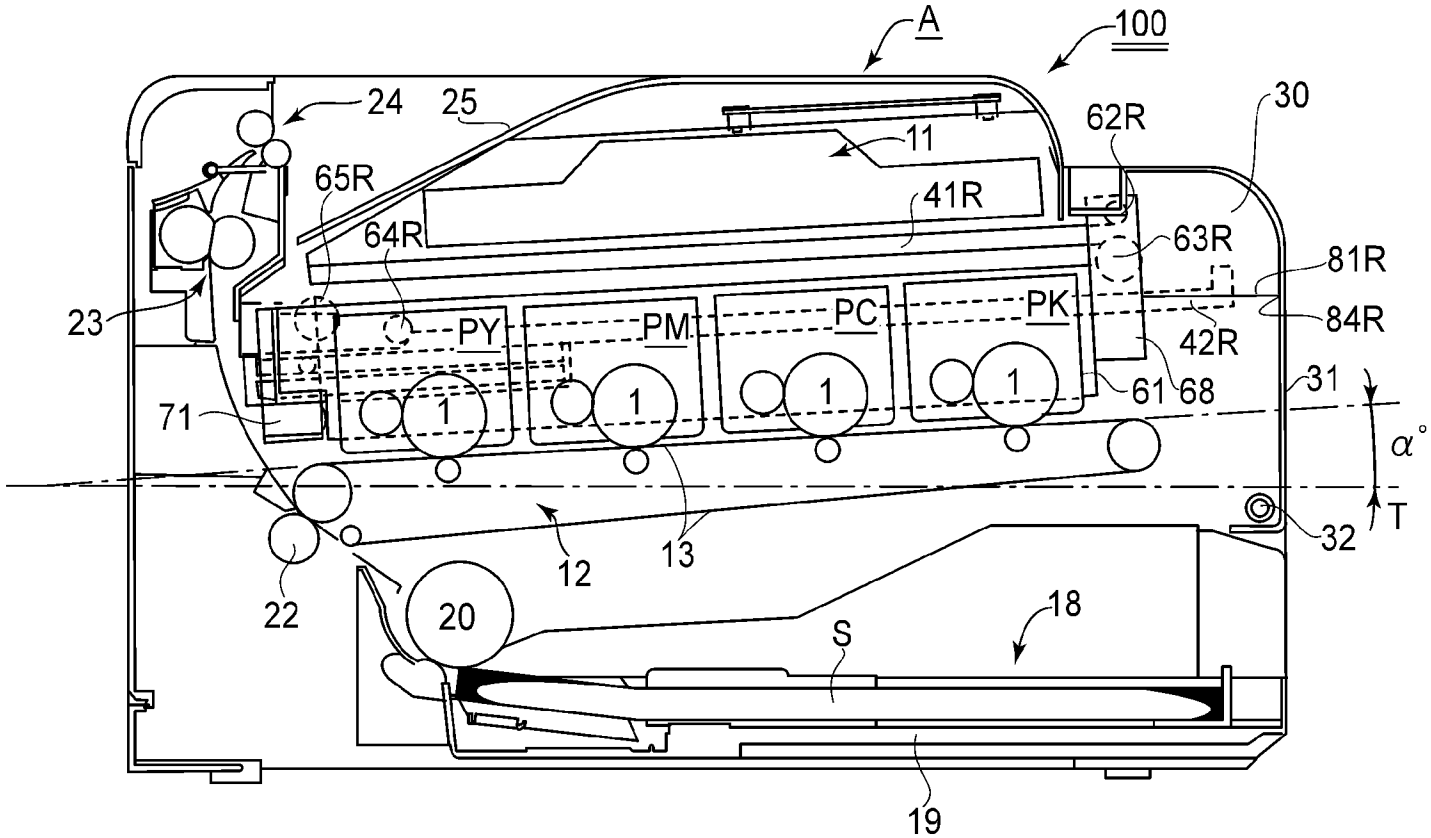
FIG. 12 is a longitudinal left side view of the image forming apparatus in Embodiment 2.
Figure 13:
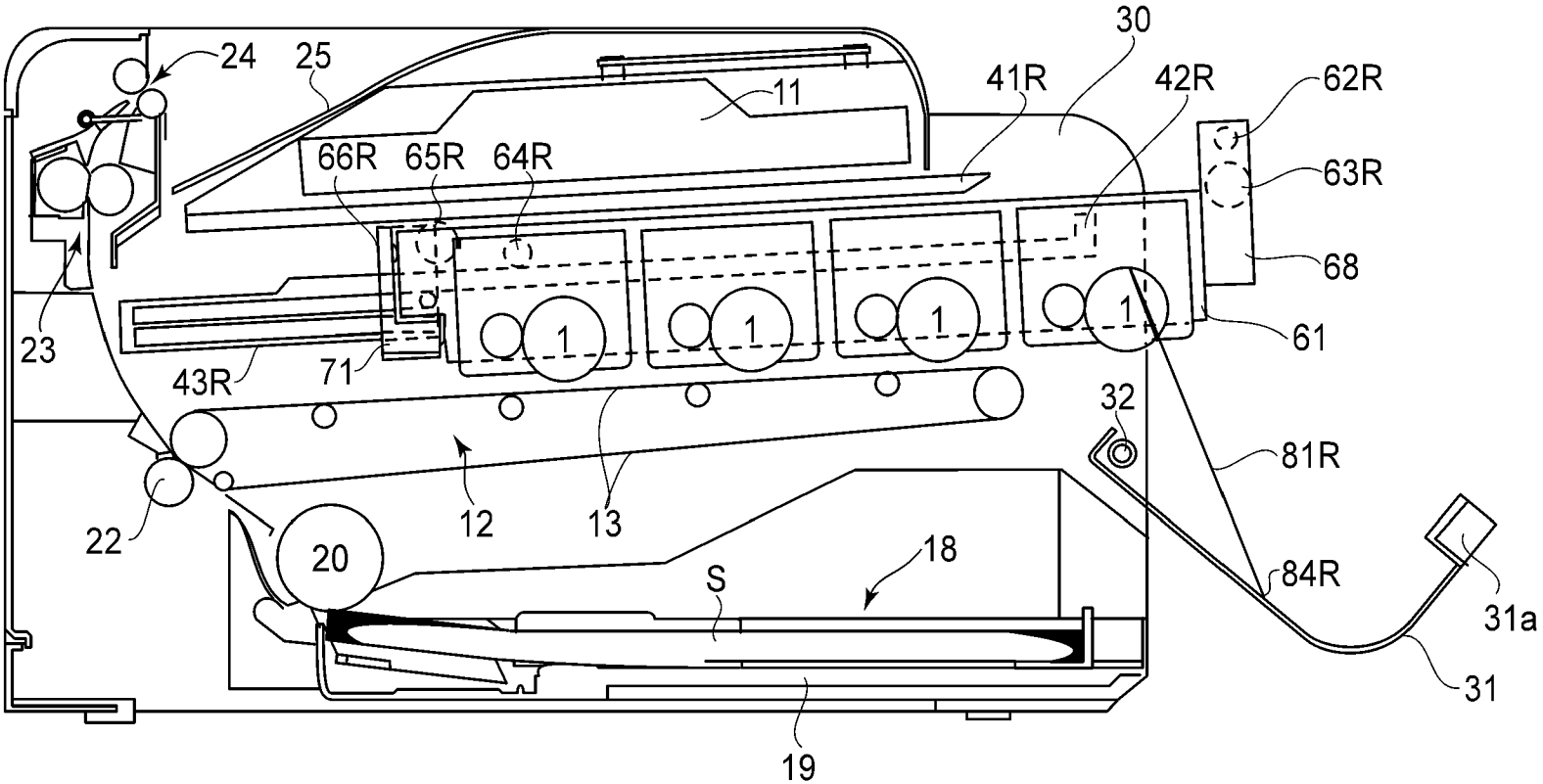
FIG. 13 is a longitudinal left side view of the image forming apparatus in a state in which the door is sufficiently opened.

As shown in FIG. 12, when the closed door 31 is opened, the slidable member 71 is pulled through the wires 81L and 81R to start the forward movement from the most rearward position. In the state in which the door 31 is sufficiently opened to the rotational movement end point to move the slidable member 71 to the forwardest position, the tray 61 is placed in a state in which a front frame 61*a* having passed through the exposed opening 30 is located outside the apparatus main assembly A as shown in FIG. 13. That is, a part of the tray 61 has passed through the opening 30 and is placed in a state in which it is exposed outside the apparatus main assembly A. In these states, the operations of the tray 61 and the slidable member 71 are similar to those in the image forming apparatus 100 in Embodiment 1.

In the state in which the door 31 is sufficiently opened to the rotational movement end point, rotational movement moment of the door 31 about the hinge shaft 32 in the opening direction by the weight of the door 31 is larger than a pullback force by the weights of the tray 61 and the slidable member 71. As a result, the opened state of the door 31 is kept stable even when the user moves his (her) hand off the opened door 31.

Figure 14:
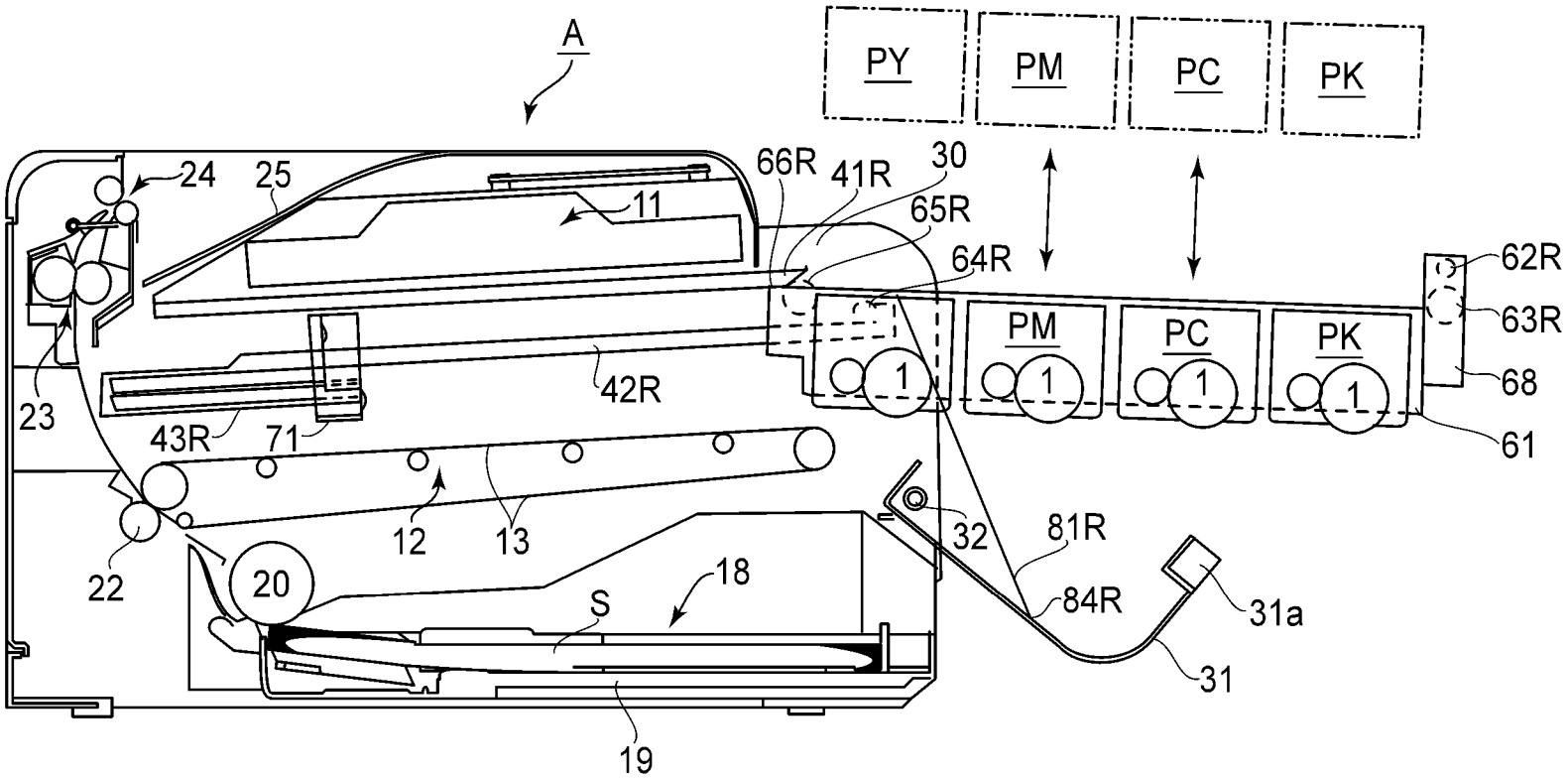
FIG. 14 is a longitudinal left side view of the image forming apparatus in a state in which the pull-out tray is pulled out to the pulled-out position.
Figure 15:
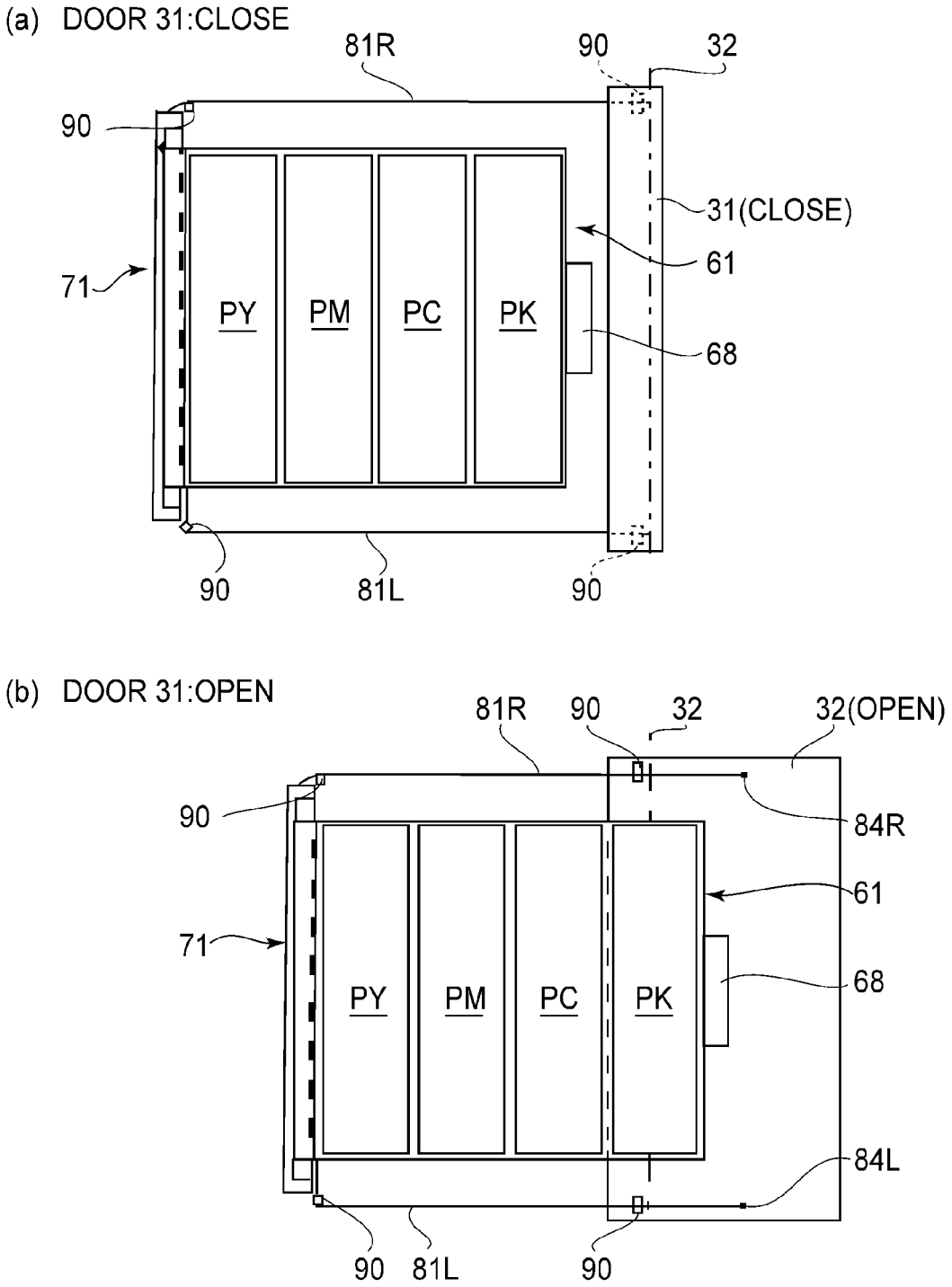
FIGS. 15(*a*) and 15(*b*) are schematic views showing a state of the wire, the slidable member, and the pull-out tray when the door is closed and opened, respectively.

FIGS. 15(*a*) and 15(*b*) are schematic views for illustrating the operations of the wires 81L and 81R, the slidable member 71, and the tray 61. The door 31 and the slidable member 71 are connected through the wires 81L and 81R. When the door 31 is opened to the position of FIG. 13, the thrust member 71 is moved, so that the front frame 61*a* of the tray 61 passes through the opening 30 and is located outside the apparatus main assembly A. That is, the door 31 is opened, so that the front side of the tray 61 is projected from the inside of the apparatus main assembly A to the outside of the apparatus main assembly A. Then, the user grips the grip portion 86 at the front surface of the front frame 61*a* and pulls out the tray 61 sufficiently forward as shown in FIG. 14. The pulled-out state of the tray 61 is stably kept similarly as in the case of the image forming apparatus 100 in Embodiment 1. At this position, the user performs the exchange of the cartridge.

When the exchange of the cartridge with respect to the tray 61 is performed, from the position of FIG. 14, the tray 61 is pushed into the apparatus main assembly A. During this operation, the operation of the tray 61 is similar to that in the image forming apparatus 100 in Embodiment 1. In this embodiment, the tray 61 pushed in the apparatus main assembly A is moved toward the rear end of the apparatus main assembly A by its own weight to reach the position in which the slidable member 71 located at the forwardest position contacts the stopper member 74, thus being placed in the state shown in FIG. 13.

Then, when the door 31 is rotationally closed, the wires 81L and 81R are loosened, so that the stopper member 74 is pushed rearward into the apparatus main assembly A by the weight of the tray 61. The door 31 is sufficiently closed rotationally, and the image forming apparatus 100 is placed in the state of FIG. 12, i.e., in the printable state. During these operations, the operations of the tray 61 and the slidable member 71 are similar to those in the image forming apparatus 100 in Embodiment 1.

Also in Embodiment 2, similarly as in Embodiment 1, the slidable member 71 may be interrelated with the damper springs 83L and 83R and may include the locking mechanisms 76L and 76R. Further, the tray 61 may also be pushed into the printable position of FIG. 12 by the door 31.

[Embodiment 3]

Figure 16:
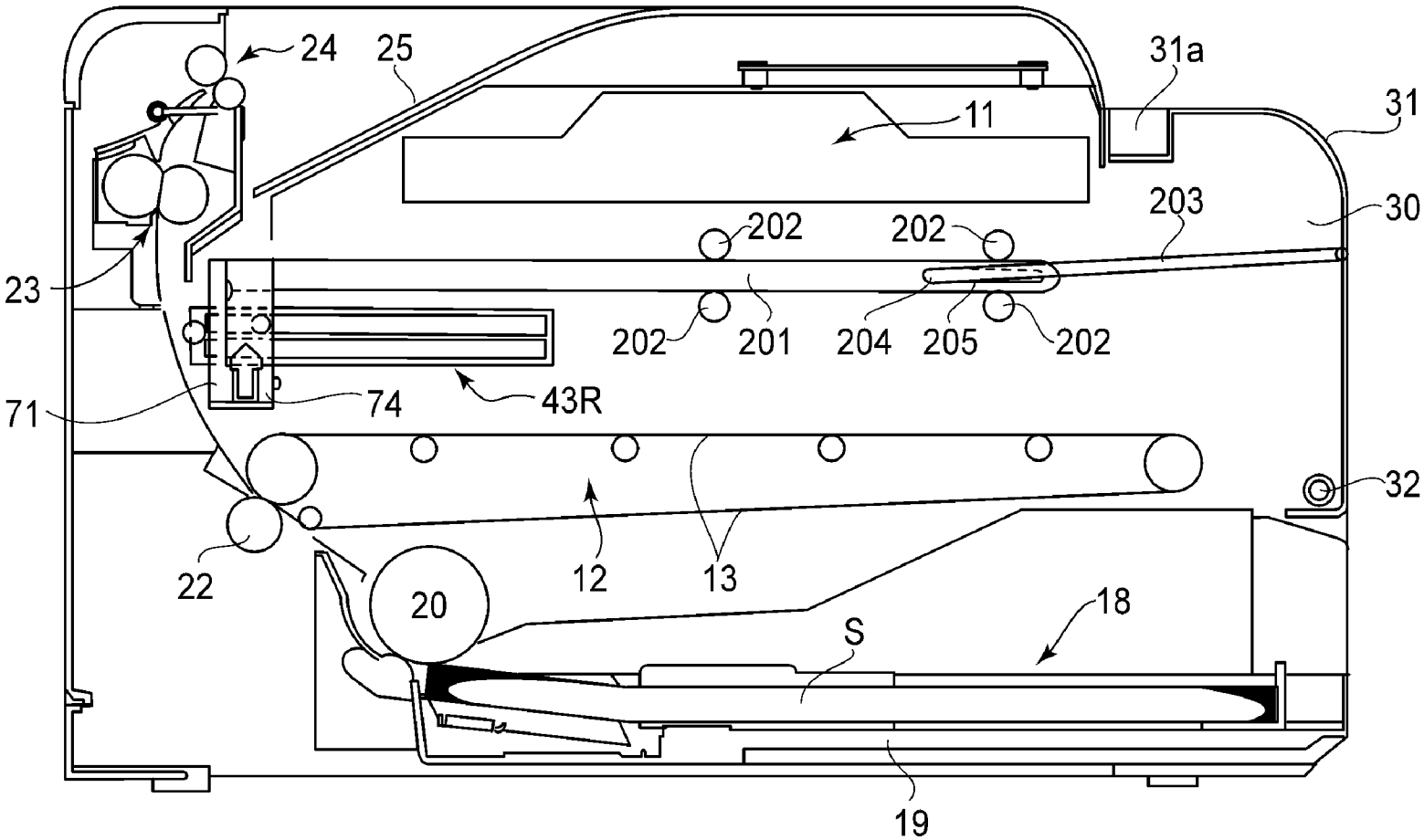
FIG. 16 is a longitudinal left side view of the image forming apparatus in Embodiment 3.
Figure 17:
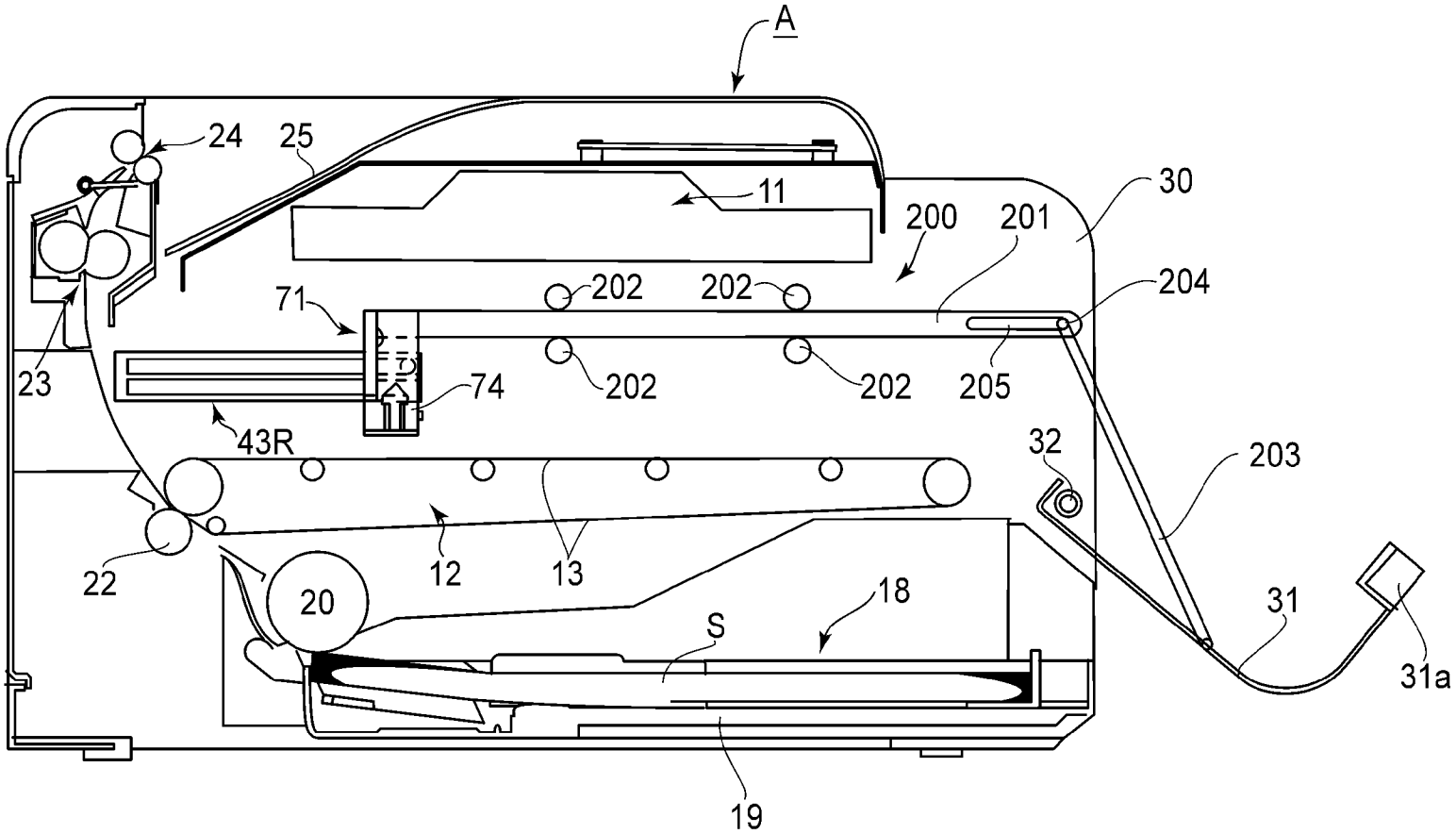
FIG. 17 is a longitudinal left side view of the image forming apparatus in a state in which the door is sufficiently opened.

In Embodiments 1 and 2, the wires 81L and 81R are used as the connecting member for connecting the door 31 and the slidable member 71 but in this embodiment, a link mechanism 200 is used as shown in FIGS. 16 and 17. In this embodiment, the link mechanism 200 includes a first member 201 movable forward while being held by guiding rollers 202. To a rear end of the first member 201, the slidable member 71 is connected. The link mechanism also includes a second member 203, which is rotatably connected to the door 31 at one end thereof. Further, a pin 204 provided to the other end of the second member 203 engages in a slit hole 205 provided to the front end portion of the first member 201. By this link mechanism 200, in interrelation with the opening and closing operations of the door 31, the slidable member 71 moves between the forwardest position and the most rearward position. Incidentally, in FIGS. 16 and 17, the tray 61 and the guide members are omitted for convenience of explanation.

As described in Embodiments 1, 2 and 3, the image forming apparatus including the pull-out tray 61 in which the cartridges are accommodated is provided with the slidable member 71 operating in interrelation with the opening and closing of the door 31. When the door 31 is opened, the part of the tray 61 is moved from the inside position to the outside of the apparatus main assembly A by the forward movement of the slidable member 71. When the door 31 is closed, the tray 61 is moved to the inside position inside the apparatus main assembly A by the backward movement of the slidable member 71. That is, in interrelation with the opening and closing movement of the door 31, the tray 61 operates, so that the operativity of the tray 61 is improved and the exchange operation property of the cartridge is improved.

In the above-described embodiments, the cartridge is the process cartridge prepared by integrally supporting the image bearing member 1 and the process means, acting on the image bearing member 1, consisting of the charging means 2, the developing means 3 and the cleaning means 4 into a cartridge but is not limited thereto. That is, the cartridge may only be required to include at least the image bearing member on which the latent image is to be formed and the developing means for developing the latent image, formed on the image bearing member, with the developer. The process means is, e.g., at least one of the charging means, the developing means, and the cleaning means. The image bearing member is the member on which the latent image to be developed with the developer is to be formed. The image bearing member may also be the electrostatic recording dielectric member in the electrostatic recording process, the magnetic recording magnetic member in the magnetic recording process, and the like, in addition to the electrophotographic photosensitive member in the electrophotographic process as in the embodiments.

In the above-described embodiments, the tray 61 as the movable member is configured to support the four cartridges PY, PM, PC and PK disposed in parallel to each other with respect to the movement direction of the tray 61. However, the cartridges to be supported by the tray 61 may also be a single cartridge. Further, it is also possible to constitute the image forming apparatus in which two, three or five or more cartridges are supportable side by side on the tray 61.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 274278/2008 filed Oct. 24, 2008, which is hereby incorporated by reference.

What is claimed is:

1. An image forming apparatus for forming an image on a recording material, comprising:

a cartridge including at least one of an image bearing member on which a latent image is to be formed and developing means for developing with a developer the latent image formed on the image bearing member;

a main assembly including an opening;

an openable member movable between a closed position in which the opening is covered and an open position in which the opening is exposed;

a movable member for supporting said cartridge, said movable member being movable between an inside position in which said cartridge is located inside said main assembly and a pulled-out position in which said movable member having passed through the opening is outwardly pulled-out from said main assembly and said cartridge is mountable to and demountable from said movable member outside said main assembly; and a slidable member, releasably connectable to said movable member, connected to said openable member through a connecting member, wherein said movable member is movable in a movement direction from the inside position toward the pulled-out position by movement of said openable member from the closed position to the open position, so that said movable member is located at an exposed position in which a part of said movable member having passed through the opening is exposed outside said main assembly, wherein said openable member is prevented from moving from the open position to the closed position in a state in which said movable member is located outside the exposed position but is movable from the open position to the closed position in a state in which said movable member is located at the exposed position, wherein in a state in which said slidable member is connected to said movable member, said slidable member is moved in a direction toward the pulled-out position by movement of said openable member from the closed position to the open position and is moved in a direction toward the inside position by movement of said openable member from the open position to the closed position, wherein by the movement of said openable member from the closed position to the open position, said movable member is located at the exposed position in a state in which said movable member is connected to said slidable member, and wherein in a state in which said movable member is not connected to said slidable member, said openable member is configured so as not to move from the open position to the closed position.

2. An apparatus according to claim 1, further comprising an urging member for urging and moving said slidable member in a direction toward the inside position.

3. An apparatus according to claim 1, wherein said slidable member and said movable member are provided so as to move in an obliquely downward direction toward the inside position by their own weight.

4. An apparatus according to claim 1, wherein said movable member is movable in a direction intersecting with a longitudinal direction of the image bearing member or the developing means of said cartridge.

5. An apparatus according to claim 1, wherein said cartridge includes a plurality of cartridge portions, and wherein said movable member is capable of supporting the plurality of cartridge portions side by side with respect to the movement direction.

6. An apparatus according to claim 5, wherein said movable member supports the plurality of cartridge portions so that the cartridge portions can be successively demounted from a downstream cartridge portion with respect to the movement direction, and wherein at the pulled-out position, all the cartridge portions are demountable.

7. An apparatus according to claim 1, wherein at the pulled-out position, said movable member supports said cartridge so as to be demountable from above and supports said cartridge by moving said cartridge from below.

* * * * *